US007990358B2

(12) United States Patent
Ishihara

(10) Patent No.: US 7,990,358 B2
(45) Date of Patent: Aug. 2, 2011

(54) DISPLAY APPARATUS

(75) Inventor: Tomoyuki Ishihara, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 1019 days.

(21) Appl. No.: 11/884,531

(22) PCT Filed: Mar. 7, 2006

(86) PCT No.: PCT/JP2006/004383

§ 371 (c)(1),
(2), (4) Date: Aug. 17, 2007

(87) PCT Pub. No.: WO2006/098189

PCT Pub. Date: Sep. 21, 2006

(65) Prior Publication Data

US 2008/0170026 A1 Jul. 17, 2008

(30) Foreign Application Priority Data

Mar. 14, 2005 (JP) ..... 2005-071976

(51) Int. Cl.
*G09G 3/36* (2006.01)

(52) U.S. Cl. ..... 345/99; 345/87; 345/100

(58) Field of Classification Search ..... 345/87–102, 345/76–82, 204, 690
See application file for complete search history.

(56) References Cited

U.S. PATENT DOCUMENTS 6,094,243 A 7/2000 Yasunishi
6,229,516 B1 * 5/2001 Kim et al. ..... 345/103
6,396,469 B1 5/2002 Miwa et al.
6,683,595 B2 1/2004 Ikeda
6,970,148 B2 11/2005 Itoh et al.
7,057,586 B2 * 6/2006 Moon ..... 345/75.2
2001/0052886 A1 12/2001 Ikeda
2002/0003520 A1 1/2002 Aoki
2002/0018057 A1 * 2/2002 Sano ..... 345/204
2003/0011614 A1 1/2003 Itoh et al.
2003/0020677 A1 1/2003 Nakano
2003/0156092 A1 8/2003 Suzuki et al.
2003/0218587 A1 11/2003 Ikeda
2004/0196254 A1 * 10/2004 Mizumaki ..... 345/103
2005/0156843 A1 7/2005 Itoh et al.

FOREIGN PATENT DOCUMENTS

JP 9-319342 12/1997

(Continued)

*Primary Examiner* — Duc Dinh
(74) *Attorney, Agent, or Firm* — Harness, Dickey & Pierce, P.L.C.

(57) ABSTRACT

In one embodiment of the present invention, a display module includes a display screen divided in a vertical direction into screen regions in each of which an image can be independently displayed. A control device for controlling an image display operation of the display module includes: upper- and lower-screen data selectors for each dividing an input image signal in accordance with a corresponding one of the screen regions; and upper- and lower-screen time-division gradation conversion blocks for each generating a display signal for each of a plurality of sub-frames from an image signal, corresponding to a corresponding one of the screen regions, which is outputted from a corresponding one of the data selectors. This makes it possible to provide an image display device in which, even when a sub-frame display is carried out, the voltage of an image signal can be applied to a pixel for a longer time so as to be sufficiently applied to the pixel.

61 Claims, 8 Drawing Sheets

FOREIGN PATENT DOCUMENTS

| | | | |
|---|---|---|---|
| JP | 10/268261 | | 10/1998 |
| JP | 11-030968 | | 2/1999 |
| JP | 11-109921 | | 4/1999 |
| JP | 2000-322018 | | 11/2000 |
| JP | 2000322018 A | * | 11/2000 |
| JP | 2001-296841 | | 10/2001 |
| JP | 2001-337643 | | 12/2001 |
| JP | 3295437 | | 4/2002 |
| JP | 2003-44007 | | 2/2003 |
| JP | 2003-241721 | | 8/2003 |
| JP | 2004-309657 | | 11/2004 |

* cited by examiner

CASE WHERE NUMBER OF SUB-FRAMES INTO WHICH FRAME IS DIVIDED IS TWO

IMAGE SIGNAL TIMING

SIMPLE TIME-DIVISION DRIVING
(CASE WHERE FRAME IS DIVIDED INTO TWO PARTS)

DISPLAY APPARATUS

TECHNICAL FIELD

The present invention relates to an image display which, by time-dividing, into a plurality of sub-frames, a single frame that displays a single image, and by displaying, in a single frame period, images respectively corresponding to the plurality of sub-frames, displays an image corresponding to the single frame.

BACKGROUND ART

In recent years, hold display apparatuses including liquid crystal display modules and/or EL display modules have gone into use in a field where CRTs (cathode-ray tubes) have been used.

However, it is said that such a hold display apparatus is inferior in quality of a moving image to an impulse display apparatus, such as a CRT (cathode-ray tube), in which an ON period during which an image is displayed and an OFF period during which no image is displayed are alternately repeated.

That is, in a typical hold display apparatus, the whole of one frame period corresponds to an ON period, so that an update of a frame image causes the subject to be displayed as if the subject stays in the previous position until the image is updated for the next frame. This appears as image blur to the eyes of an observer.

Conventionally, there has been proposed a sub-frame display method, having as an object to improve such a quality of a moving image, which drives a plurality of sub-frames into which a frame that displays one image has been time-divided. Examples of such a sub-frame display method are disclosed in Patent Documents 1 to 4.

Meanwhile, a display screen has conventionally been divided in a vertical direction into an upper-screen region and a lower-screen region in each of which display scanning is independently carried out. Examples of this are disclosed in Patent Documents 5 and 6.

[Patent Document 1]

Japanese Unexamined Patent Application Publication No. 302289/1992 (Tokukaihei 4-302289; published on Oct. 26, 1992)

[Patent Document 2]

Japanese Unexamined Patent Application Publication No. 281625/2001 (Tokukai 2001-281625; published on Oct. 10, 2001)

[Patent Document 3]

Japanese Unexamined Patent Application Publication No. 23707/2002 (Tokukai 2002-23707; published on Jan. 25, 2002)

[Patent Document 4]

Japanese Unexamined Patent Application Publication No. 22061/2003 (Tokukai 2003-22061; published on Jan. 24, 2003)

[Patent Document 5]

Japanese Unexamined Patent Application Publication No. 268261/1998 (Tokukaihei 10-268261; published on Oct. 9, 1998)

[Patent Document 6]

Japanese Unexamined Patent Application Publication No. 297564/1997 (Tokukaihei 9-297564; published on Nov. 18, 1997)

However, as compared with a case where a frame is not divided into sub-frames (a case of a normal hold display carried out by turning on all gate lines of a liquid crystal panel only once in one frame period), a sub-frame display carried out by driving a plurality of sub-frames into which a frame has been divided causes a reduction in time during which the voltage of an image signal is applied to a pixel.

For this reason, the voltage of an image signal cannot be sufficiently applied to a pixel due to lack of pixel charging time. This causes deterioration in display quality, and makes it impossible to increase the number of sub-frames (into which a frame is divided).

The present invention has been made in view of the foregoing problems, and it is an object of the present invention to provide a display apparatus in which sufficient pixel charging time can be obtained even when sub-frames into which a frame has been time-divided are driven.

DISCLOSURE OF INVENTION

As described above, a display apparatus of the present invention is a display apparatus for, by time-dividing a single frame into a plurality of sub-frames and by displaying, in a single frame period, images respectively corresponding to the plurality of sub-frames, displaying an image corresponding to the single frame, including: a display module having a display screen divided into a plurality of screen regions in each of which an image is able to be independently displayed; and control means for controlling an image display operation of the display module, the control means including (i) a signal division section for dividing an incoming image signal in accordance with the screen regions of the display module and (ii) a signal generation section for generating a display signal for each of the plurality of sub-frames from the incoming image signal. Note that the signal generation section generates a display signal for each of a plurality of sub-frames with the intention of remedying moving-image blur.

In case of carrying out such a sub-frame display that an image corresponding to a single frame is displayed by time-dividing the single frame into a plurality of sub-frames and by displaying a plurality of images respectively corresponding to the sub-frames, it is necessary to display, in a period corresponding to the single frame, the plurality of images respectively corresponding to the sub-frames. For this reason, when the number of sub-frames is m, the display operation is carried out m times, so that each horizontal line of the display screen is turned on m times. Therefore, a select period during which a single horizontal line is on is 1/m times as long a time as when a sub-frame display is not carried out. This makes it impossible to sufficiently apply the voltage of an image signal to a pixel.

On the other hand, according to the foregoing arrangement, a display module having a display screen divided in a vertical direction into a plurality of screen regions in each of which an image can be independently display is used. Therefore, according to the present display apparatus, when the number of screen regions is n, a select period of a single horizontal line is n times longer. With this, even when a sub-frame display is carried out, the voltage of an image signal can be applied to a pixel for a longer time so as to be sufficiently applied to the pixel.

Further, the display apparatus of the present invention is preferably arranged such that the display screen is equally divided, and that the number of screen regions into which the display screen has been divided is equal to the number of sub-frames.

With such an arrangement, the transmission frequency (transmission clock frequency, dot clock frequency) of an image signal to be inputted to the control means becomes equal to the transmission frequency of a display signal for each sub-frame. This makes it unnecessary to change the transmission frequency of a sub-frame display signal.

For example, in cases where a single frame is divided into m sub-frames, an image display needs to be carried out m times in a period corresponding to the single frame, so that the transmission frequency of a display signal for each sub-frame becomes m times higher. However, by dividing the display screen into m screen regions (causing the number of horizontal lines to be 1/m), a sub-frame period can be made to be 1/m of a frame period without changing the transmission frequency.

In this case, it is preferable that each of the number of screen regions into which the display screen has been divided and the number of sub-frames is 2. This makes it possible to easily manufacture, with use of an existing technique, a liquid crystal display module having a screen divided into two parts, and also to reduce the burden imposed on the signal generation section.

Further, the display apparatus of the present invention is preferably arranged such that the length of a period corresponding to one of the sub-frames is equal to the length of a period corresponding to another one of the sub-frames, or that the length of a single horizontal scanning period in the display module is equal to the length of a single horizontal scanning period of the incoming image signal.

According to the foregoing arrangement, the period between a point of time where an operation of displaying an image in each sub-frame is carried out and a point of time where the image displayed in the sub-frame is rewritten by an operation of displaying an image in the next sub-frame, i.e., the actual sub-frame display period is equal among all sub-frames.

With this, for example, a plurality of input frame frequencies (frame frequencies of input image signals) are dealt with. Even in cases where the length of one frame period has been changed due to a change in frame frequency of an input, there is no change in time ratio of one sub-frame period to another within one frame period, so that there is no change in time integral amount of display luminance in one frame period for each sub-frame. This makes it possible to share a gradation conversion value for each sub-frame regardless of the frame frequency, thereby reducing the cost of the signal generation section.

Depending on the response performance of the display module, it is conceivable that sub-frame periods are not equalized in length so that an effect of remedying image blur is improved. In this case, although the cost is increased, a gradation conversion value corresponding to the input frame frequency is prepared. The present invention is not limited to a case where sub-frame periods are equalized.

Further, the display apparatus of the present invention can be arranged such that the control means further includes a timing control section for generating a control signal for controlling an image display operation of each of the sub-frames, the timing control section generating a control signal so that an operation of causing each pixel of the display screen to display an image in a first sub-frame is carried out before half, or more preferably 20%, of a frame period of an image signal has elapsed since the image signal was inputted to the pixel.

According to the foregoing arrangement, an operation of causing each pixel of the display screen to display an image in a first sub-frame is carried out before half of a vertical period of an image signal has elapsed since the image signal was inputted to the pixel. This makes it possible to shorten a period between a point of time where an image signal corresponding to a given frame is inputted and a point of time where the display module displays an image corresponding to the frame. In this case, it is preferable that the operation be carried out before 20% of the vertical period has elapsed.

Therefore, in cases where the display apparatus of the present invention is used as a television receiver or the like, there occurs a problem of a time lag between a point of time where an image signal is inputted and a point of time where an image is actually displayed in accordance with the image signal. However, this problem does not cause disagreement between the displayed image and sound corresponding thereto. This eliminates the need, for example, for a circuit for delaying the sound.

Further, also in cases where the display apparatus of the present invention is used as a display apparatus of a machine, such as a personal computer or a game machine, in which the displayed image needs to be updated immediately in response to an input operation, it is possible to carry out an image display that is less affected by a time lag in response to an operation.

Specifically, in case where the frame frequency (vertical frequency) of an incoming image signal is 60 Hz, an operation of causing each pixel of the display screen to display an image in the first sub-frame is carried out before 3.3 ms has elapsed since an image signal was inputted to the pixel. This eliminates the problem of a time lag between a point of time where an image signal is inputted and a point of time where an image is actually displayed in accordance with the image signal.

Further, the display apparatus of the present invention can be arranged such that the control means further includes a timing control section for generating a control signal for controlling an image display operation of each of the sub-frames, the timing control section generating a control signal so that timing of an image display operation of each sub-frame of an identical stage varies between the screen regions in such a manner that an image display operation of each sub-frame of a given stage in an upper one of the screen regions precedes an image display operation of each sub-frame of the same stage in a lower one of the screen regions.

According to the foregoing arrangement, in carrying out an image display operation independently in each screen region, an image display operation of each sub-frame of a given stage in an upper one of the screen regions precedes an image display operation of each sub-frame of the same stage in a lower one of the screen regions. Therefore, the displayed image continues both in terms of position and time at a boundary portion between the screen regions. This makes it possible to avoid the occurrence of such a tearing phenomenon that the displayed moving image looks as if it is divided at the boundary portion. This makes it possible to improve the display quality of the moving image.

Moreover, since the timing of an image display of each sub-frame of a given stage varies between the screen regions as described above, the amount of memory required of a frame memory in which the image signal is stored can be reduced.

That is, the image signal needs to be stored in the frame memory until a display signal is prepared for the last sub-frame. For this reason, in cases where the timing of an image display of each sub-frame of a given stage is equal between the screen regions, it becomes necessary that all image signals corresponding to a single frame be stored in the frame memory.

On the other hand, according to the foregoing arrangement, since the timing of an image display of each sub-frame of the same stage varies between the screen regions, a display signal for the last sub-frame is prepared for each of the screen regions. This makes it possible to share a memory region of the frame memory between the screen regions. For example, after a display signal has been generated for the last sub-frame for use in a given screen region, an incoming image signal is stored in a memory region assigned for use in the screen region.

In cases where a memory region is shared, the amount of memory required of a frame memory depends on the number of screen regions into which the display screen is divided and the number of sub-frames and slightly varies depending on the length of a blanking interval. However, in cases where each of the number of screen regions into which the display screen is divided and the number of sub-frames is N, the amount of memory corresponds to approximately (N−1)/N frames. For example, when each of the number of screen regions into which the display screen is divided and the number of sub-frames is 2, the amount of memory corresponds to approximately half of the amount of memory for storing a one-frame image signal.

Therefore, the display apparatus of the present invention can be further arranged such that the capacity of address space, contained in a frame memory in which the incoming image signal is stored, which is used in displaying a one-frame still image corresponding to the image signal corresponds to not less than 50% of one screen and less than one screen.

Alternatively, the display apparatus of the present invention can be further arranged such that the control means further includes a memory control section for controlling writing and reading of a frame memory in which the incoming image signal is stored, when a display signal is generated for a last sub-frame corresponding to a screen region, the memory control section writes, in a region of the frame memory in which region an image signal corresponding to the screen region was stored, an incoming image signal corresponding to another screen region.

With such an arrangement, the frame memory in which the incoming image signal is stored only needs to have a small memory capacity. Alternatively, this leaves more space in the memory capacity, so that another function (e.g., overshoot driving for improving performance of response to a moving image) is added by utilizing available address space of the memory.

The display apparatus of the present invention can be further arranged such that in generating a control signal so that an image display operation of each sub-frame of an identical stage in an upper one of the screen regions precedes an image display operation of each sub-frame of the identical stage in a lower one of the screen regions, the timing control section generates a control signal so that an operation of causing each horizontal line of the display screen to display an image is carried out after a certain period of time has elapsed since an image signal was inputted to the horizontal line.

This causes the displayed image to surely continue both in terms of position and time at a boundary portion between the screen regions, so that the occurrence of a tearing phenomenon can be surely avoided in displaying a moving image. This makes it possible to further improve the display quality of the moving image.

Further, the display apparatus of the present invention may be arranged such that in generating a control signal so that an image display operation of each sub-frame of a given stage in an upper one of the screen regions precedes an image display operation of each sub-frame of the same stage in a lower one of the screen regions, the timing control section generates a control signal so that, in a given sub-frame, with respect to a delay between (i) a point of time where an image signal is inputted to each horizontal line of a first screen region of the display screen and (ii) a point of time where an operation of causing the horizontal line to display an image is carried out, a delay between (a) a point of time where an image signal is inputted to each horizontal line of a second screen region, situated next to the first screen region, which displays an image after the first screen region has displayed an image and (b) a point of time where an image display operation is carried out is equal or longer by less than 18%, or more preferably 5%, of one frame period.

It has been confirmed that deterioration in quality of a moving image due to a tearing phenomenon is limited as long as the delay between the completion of output of a display signal for a sub-frame in a given screen region and the start of output of a display signal for each sub-frame of a given stage in another adjacent screen region is less than 18%, or more preferably 5%, of one frame period. Therefore, such an arrangement simplifies designing.

Further, the display apparatus of the present invention may be arranged such that in generating a control signal so that an image display operation of each sub-frame of a given stage in an upper one of the screen regions precedes an image display operation of each sub-frame of the same stage in a lower one of the screen regions, the timing control section changes a delay between a point of time where an image signal is inputted to each horizontal line of the display screen and a point of time where an operation of causing the horizontal line to display an image is carried out, so that the delay (i) is not changed in a first sub-frame even when the length of a single frame period of the incoming image signal is changed, (ii) is not changed in a subsequent sub-frame when the length is changed by less than a predetermined reference value, and (iii) is changed in a subsequent sub-frame when the length is changed by not less than the reference value.

In cases where the display apparatus of the present invention is used as a display apparatus for a tuner section of a television receiver or a display apparatus of a personal computer, some image signal sources (external input apparatuses) may cause a fluctuation in length of an input one frame period. For example, an input one frame with the standard total number of lines T may randomly fluctuate between T−3 and T+3. Such a change in input one frame period can be handled by always finely adjusting the length of each sub-frame period in accordance with the total number of lines of the input one frame. However, this causes an increase in cost of the control device. The foregoing arrangement makes it possible to avoid such a cost rise.

Further, the display apparatus of the present invention can be further characterized in that a display signal for each sub-frame subsequent to a first sub-frame is generated by using an image signal read out from a frame memory in which the incoming image signal is stored and that a display signal for the first sub-frame is generated by directly using the incoming image signal without reading any image signal from the frame memory.

As described above, the display screen is equally divided and the number of screen regions into which the display screen is divided is equal to the number of sub-frames, so that the transmission frequency of an image signal to be inputted to the control means becomes equal to the transmission frequency of a display signal for each sub-frame. This makes it unnecessary to change the transmission frequency of a sub-frame display signal. This means that the input image signal can be directly used without being so stored in the memory that its transmission frequency is changed.

The foregoing arrangement makes use of this. That is, a display signal for the first sub-frame is generated by using the incoming image signal without reading out any image signal from the memory. Therefore, the number of times the frame memory is accessed (written and read) is reduced, so that the memory bandwidth of the frame memory can be reduced.

Further, the display apparatus of the present invention is preferably arranged such that a vertical blanking interval of a display signal for each sub-frame of each screen region corresponds to a fraction obtained by dividing a vertical blanking interval of the incoming image signal by the number of sub-frames.

With this, the period between a point of time where an operation of displaying an image in each sub-frame is carried out and a point of time where the image displayed in the sub-frame is rewritten by an operation of displaying an image in the next sub-frame, i.e., the actual sub-frame display period is equal among all sub-frames.

Further, in addition to the foregoing arrangement, the display apparatus of the present invention may further include receiving means, receiving a television broadcast, which inputs, to the control device of the display apparatus, an image signal indicating an image transmitted by the television broadcast, wherein: the display module is a liquid crystal display module; and the display apparatus operates as a liquid crystal television receiver. Furthermore, in addition to the foregoing arrangement, the display apparatus of the present invention may be arranged such that: the display module is a liquid crystal display module; and the control device receives an external image signal; and the display apparatus operates as a liquid crystal monitor apparatus that displays an image indicated by the image signal.

Additional objects, features, and strengths of the present invention will be made clear by the description below. Further, the advantages of the present invention will be evident from the following explanation in reference to the drawings.

BRIEF DESCRIPTION OF DRAWINGS

FIG. 8(*b*) is a diagram showing how a boundary between two regions of difference luminance moves at the time of pseudo-impulse driving.

REFERENCE NUMERALS

1 Image display apparatus (display apparatus)
2 Pixel array (display section)
10 Control device (control means)
11 Frame memory (frame memory)
12 Memory controller (memory control section)
13 Timing controller (timing control section)
14 Upper-screen data selector (signal division section)
15 Lower-screen data selector (signal division section)
16 Upper-screen time-division gradation conversion block (signal generation section)
17 Lower-screen time-division gradation conversion block (signal generation section)
19 Display module

MODE FOR CARRYING OUT THE INVENTION

An embodiment of the present invention will be described below with reference to FIGS. 1 through 8.

That is, a display apparatus according to the present embodiment (such a display apparatus being hereinafter referred to as "present image display apparatus") is a display apparatus in which sufficient pixel charging time is obtained even when sub-frames into which a frame has been time-divided are driven, and can be suitably applied, for example, to a television receiver and a display monitor that is to be connected a personal computer.

Note that examples of television broadcasts to be received by such a television receiver include (i) broadcasts, such as terrestrial television broadcasts, BS (Broadcasting Satellite) digital broadcasts, and CS (Communication Satellite) digital broadcasts, which are provided via satellites or (ii) cable television broadcasts.

Figure 1:
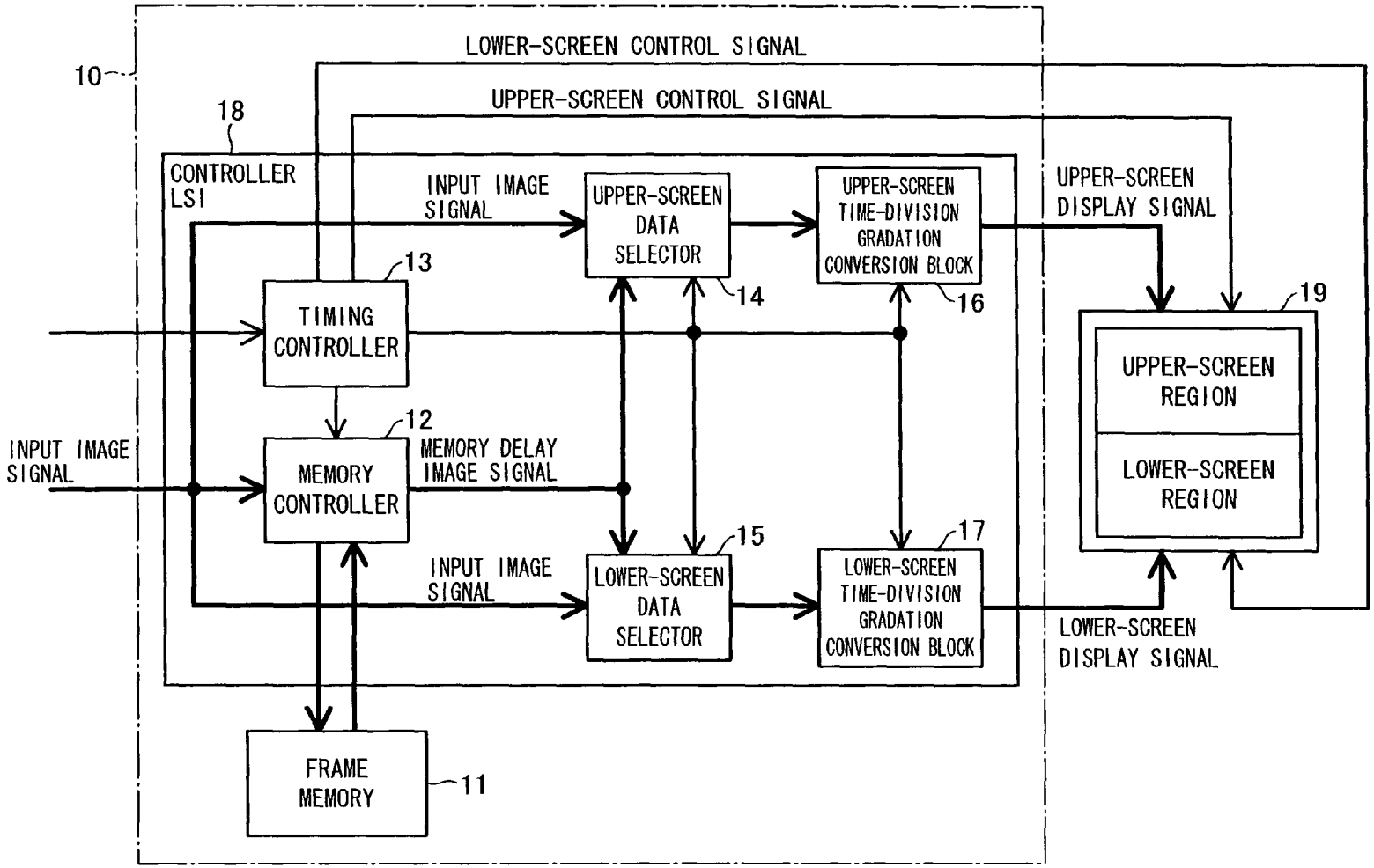
FIG. 1 shows an embodiment of the present invention, and is a block diagram showing an arrangement of a main part of an image display apparatus.

As shown in FIG. 1, the present image display apparatus includes a display module 19 and a control section 10. The display module 19 has a display screen divided in a vertical direction into an upper-screen region and a lower-screen region. The upper-screen region and the lower-screen region are each independently driven, so that an image can be displayed and scanned in each of the screen regions.

Examples of the display module 19 include hold display modules such as EL display modules and liquid crystal display modules. The present image display apparatus employs a vertically aligned liquid crystal cell in which liquid crystal molecules are aligned substantially perpendicularly to substrates when no voltage is applied and in which the liquid crystal molecules are tilted out of the vertical alignment in accordance with a voltage applied to respective liquid crystal capacitors of pixels. The liquid crystal cell is used in a normally black mode (a mode in which a black display is carried out when no voltage is applied).

Figure 2:
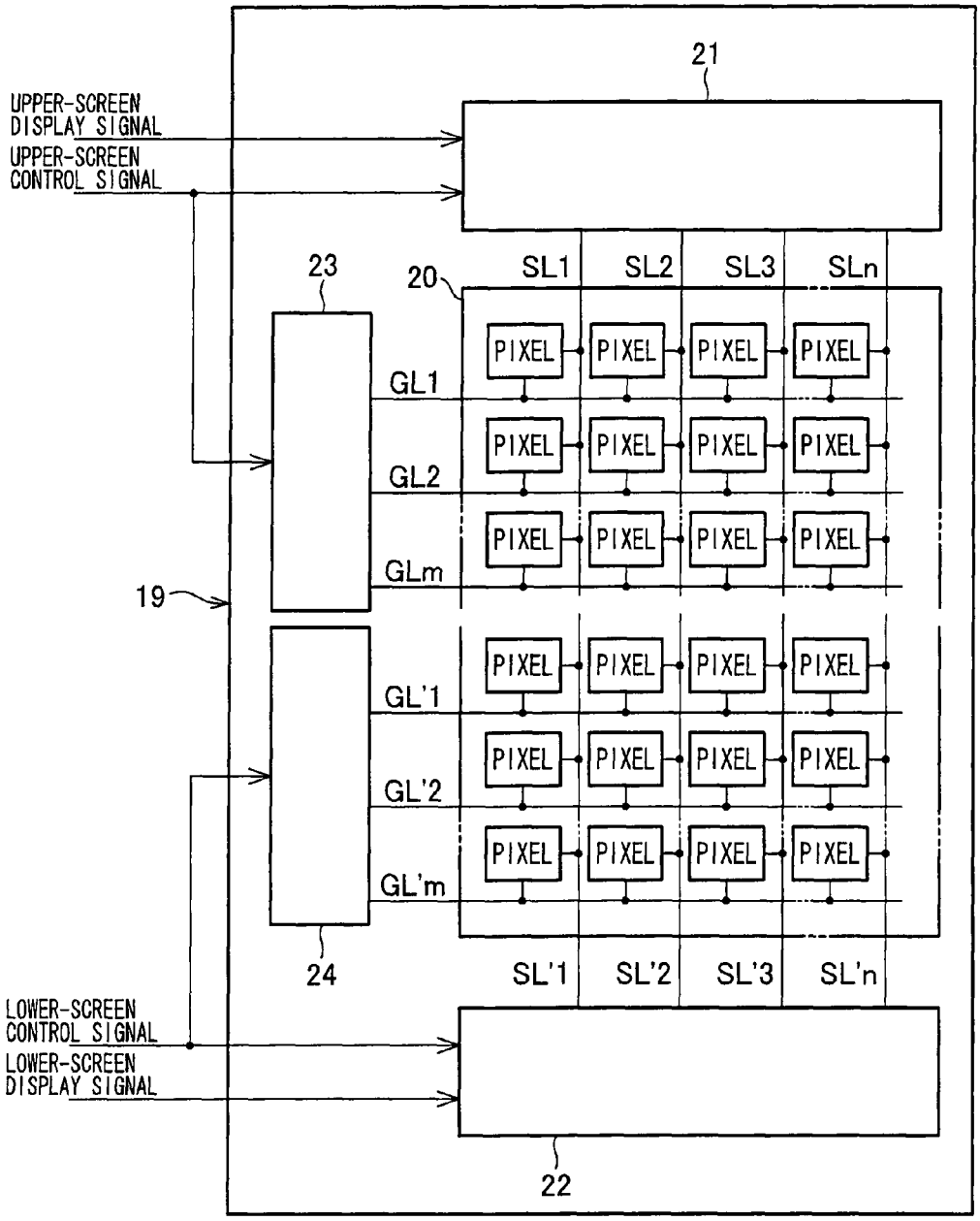
FIG. 2 is a circuit diagram showing an example arrangement of pixels provided in the image display apparatus.

FIG. 2 is a diagram showing the display module 19 in detail. The display module 19 includes a pixel array 20, having a plurality of pixels arrayed in a matrix manner, which is divided into two parts respectively corresponding to the upper-screen region and the lower-screen region. Pixels contained in the upper-screen region are arrayed on points of intersection between data signal lines SL1 to SLn and scanning signal lines (horizontal lines) GL1 to GLm, respectively. Pixels contained in the lower-screen region are arrayed on points of intersection between data signal lines SL'1 to SL'n and scanning signal lines (horizontal lines) GL'1 to GL'm, respectively.

Provided around the pixel array 20 are an upper-screen data signal line driver 21 for driving the data signal lines SL1 to SLn, an upper-screen scanning signal line driver 23 for driving the scanning signal lines GL1 to GLm, a lower-screen data signal line driver 22 for driving the data signal lines SL'1 to SL'n, and a lower-screen scanning signal line driver 24 for driving the scanning signal lines GL'1 to GL'm.

The upper-screen data signal line driver 21 receives an upper-screen display signal and an upper-screen control signal from the control section 10 described later, and the upper-screen scanning signal line driver 23 receives the upper-screen control signal from the control section 10. Further, the lower-screen data signal line driver 22 receives a lower-screen display signal and a lower-screen control signal from the control section 10, and the lower-screen scanning signal line driver 24 receives the lower-screen control signal from the control section 10.

Each of the scanning signal line drivers 23 and 24 sends, to its corresponding scanning signal lines GL1 to GLm or GL'1 to GL'm, a signal, such as a voltage signal, which indicates whether or not the scanning signal lines are in a select period. In so doing, each of the scanning signal line drivers 23 and 24 selects, in accordance with a timing signal such as the corresponding upper-screen or lower-screen control signal (a clock signal GCK or a start pulse signal GSP), a scanning signal line GL or GL' to which a signal indicative of a select period is to be sent. With this, the scanning signal lines GL1 to GLm or GL'1 to GL'm are sequentially switched from one to another at a predetermined timing.

Meanwhile, the upper-screen data signal line drivers 21 drives the data signal lines SL1 to SLn in accordance with the corresponding upper-screen control signal, and supplies, to the data signal lines SL1 to SLn, a voltage indicated by the upper-screen display signal. Similarly, the lower-screen data signal line drivers 22 drives the data signal lines SL'1 to SL'n in accordance with the corresponding lower-screen control signal, and supplies, to the data signal lines SL'1 to SL'n, a voltage indicated by the lower-screen display signal.

On this occasion, the upper-screen data signal line drivers 21 samples, at a predetermined timing, display signals to be respectively inputted as upper-screen display signals to the pixels in a time-division manner, thereby extracting the display signals. Similarly, the lower-screen data signal line drivers 22 samples, at a predetermined timing, display signals to be respectively inputted as lower-screen display signals to the pixels in a time-division manner, thereby extracting the display signals. Moreover, the upper-screen data signal lines driver 21 outputs signals respectively corresponding to the display signals. The signals thus outputted are sent, via the data signal lines SL1 to SLn, to pixels corresponding to the scanning signal line GL currently selected by the corresponding scanning signal line driver 23, respectively. Similarly, the lower-screen data signal line driver 22 outputs signals respectively corresponding to the display signals. The signals thus outputted are sent, via the data signal lines SL'1 to SL'n, to pixels corresponding to the scanning signal line GL currently selected by the corresponding scanning signal line driver 24, respectively.

Each of the upper-screen data signal line driver 21 and the lower-screen data signal line driver 22 determines, in accordance with a timing signal, such as the corresponding upper-screen or lower-screen control signal (a clock signal SCK or a start pulse signal SSP), which is sent from the control device 10, a timing at which the sampling is carried out and timings at which the signals are outputted.

The brightness of each of the pixels of the pixel array 20 is determined in the following manner. That is, while a scanning signal line GL or GL' corresponding to the pixel is being selected, the luminance, transmittance, or the like of the pixel at the time of emission of light is adjusted in accordance with an output signal supplied to the data signal lines SL1 to SLn or SL'1 to SL'n corresponding to the pixel.

Meanwhile, the control device 10 controls a display operation of the display module 19. The control device 10 generates, in accordance with an incoming image signal (input image signal) and an external control signal (input control signal), a display signal and a control signal by each of which the display module 19 is driven, and then outputs the display signal and the control signal.

The present image display apparatus carries out a sub-frame display by time-dividing a frame into sub-frames. Therefore, the control device 10 generates, as a plurality of sub-frame display signals, a display signal that is to be supplied to the display module 19.

In addition, since the present image display apparatus is arranged such that the display module 19 is divided into the upper-screen region and the lower-screen region, the control device 10 generates, in accordance with the screen regions, an upper-screen display signal and an upper-screen control signal each of which is used for a display that is to be carried out in the upper-screen region and a lower-screen display signal and a lower-screen control signal each of which is used for a display that is to be carried out in the lower-screen region.

In cases where the present image display apparatus is a television receiver, examples of an image signal source that transmits an input image signal and an input control signal to such a control device 10 include a tuner (receiving means) for receiving a television broadcast, and for generating an image signal indicative of an image transmitted by the television broadcast. Further, in cases where the present image display apparatus is a display monitor, examples of the image signal source include a personal computer.

The present image display apparatus illustrates a case where a digital image signal is transmitted in frame as an input image signal from an image signal source to the control device 10. That is, the image signal source transmits image signals to the control device 10 in such a manner as to transmit image signals for respective frames in a time-division manner. For example, after the image signal source has transmitted all image signals corresponding to a given frame, the image signal source transmits image signals corresponding to the next frame.

Further, the frame is constituted by a plurality of horizontal lines, and the input image signal is such that image signals for respective horizontal lines are transmitted in a time-division manner. For example, after all image signals for respective horizontal lines in a given frame have been transmitted, image signals for respective horizontal lines in the next frame are transmitted. Furthermore, the image signal source also transmits, in a time-division manner, an image signal corresponding to one horizontal line, so that image signals for pixels arrayed in one horizontal line are transmitted one after another in a predetermined order.

The control device 10 outputs the upper-screen display signal and the lower-screen display signal each generated in accordance with the input image signal transmitted from the image signal source. Each of the upper-screen display signal and the lower-screen display signal is also constituted by display signals that are to be respectively sent to pixels arrayed in the corresponding screen region and each frame is divided into sub-frames, so that image signals to be respectively sent to pixels in a given frame are given as a combination of image signals that are to be respectively sent to pixels in each sub-frame. Image signals in these sub-frames are also transmitted in a time-division manner.

More specifically, the control device 10 transmits an upper-screen display signal or a lower-screen display signal in the following manner. That is, after the control device 10 has transmitted all display signals corresponding to a given frame, the control device 10 transmits display signals corresponding to the next frame, thereby transmitting display signals for respective frames in a time-division manner. Further, each of the frames is constituted by a plurality of sub-frames. For example, after all display signals for a given sub-frame have been transmitted, display signals for the next sub-frame are transmitted, so that display signals for respective sub-frames are transmitted in a time-division manner.

Similarly, each sub-frame display signal is constituted by a plurality of horizontal-line display signals, each of which is constituted by display signals that are to be respectively sent to pixels. Furthermore, the control device 10 transmits display signals for a given sub-frame in such a manner as to transmit display signals for respective horizontal lines in a time-division manner. For example, after all display signals for a given horizontal line have been transmitted, display signals for the next horizontal line are transmitted. As well, the control device 10 transmits display signals for respective horizontal lines, for example, so as to transmit display signals for respective pixels one after another in a predetermined order.

The following fully explains an arrangement and operation of the control device 10. As shown in FIG. 1, the control device 10 of the present image display apparatus includes a frame memory 11, a memory controller 12, a timing controller 13, an upper-screen data selector 14, a lower-screen data selector 15, an upper-screen time-division gradation conversion block 16, and a lower-screen time-division conversion block 17. Among these, the memory controller 12, the timing controller 13, the upper-screen data selector 14, the lower-screen data selector 15, the upper-screen time-division gradation conversion block 16, and the lower-screen time-division conversion block 17 are mounted in a controller LSI 18.

An image signal (input image signal) sent from the image signal source branches off at an input stage of the controller LSI 18 into the memory controller 12, the upper-screen data selector 14, and the lower-screen data selector 15.

The memory controller (memory control section) 12 controls writing and reading with respect to the frame memory (frame memory) 11. The memory controller 12 receives the input image signal and writes the input image signal in the frame memory 11. At the same time, the memory controller 12 reads out a memory delay image signal and sends the memory delay image signal to the upper-screen data selector 14 and the lower-screen data selector 15.

Each of the upper-screen data selector 14 and the lower-screen data selector 15 serves as a signal division section of the present invention, and divides an image signal in accordance with a corresponding one of the screen regions. These selectors 14 and 15 receive the input image signal that has branched off into the selectors 14 and 15 and the memory delay image signal transmitted via the memory controller 12.

Among these, the upper-screen data selector 14 generates a display signal for a first sub-frame by selecting only that portion of the input image signal which corresponds to the upper-screen region and by sending the selected portion to the upper-screen time-division gradation conversion block 16, and generates a display signal for a second sub-frame by selecting only that portion of the memory delay image signal which corresponds to the upper-screen region and by sending the selected portion to the upper-screen time-division gradation conversion block 16. Assume here that the first sub-frame precedes the second sub-frame.

The same is equally true of the lower-screen data selector 15. That is, the lower-screen data selector 15 generates a display signal for the first sub-frame by selecting only that portion of the input image signal which corresponds to the lower-screen region and by sending the selected portion to the lower-screen time-division gradation conversion block 17, and generates a display signal for a second sub-frame by selecting only that portion of the memory delay image signal which corresponds to the lower-screen region and by sending the selected portion to the lower-screen time-division gradation conversion block 17.

Each of the upper-screen time-division gradation conversion block 16 and the lower-screen time-division conversion block 17 serves as a signal generation section of the present invention, and generates, from an image signal inputted thereto, a display signal for a corresponding one of the first and second sub-frames with the intention of bringing about an effect of remedying image blur.

Each of the upper-screen time-division gradation conversion block 16 and the lower-screen time-division conversion block 17 performs, in accordance with the image signal transmitted from a corresponding one of the data selectors 14 and 15 so as to correspond to a corresponding one of the screen regions, a process (sub-frame process) of dividing one frame period into a plurality of sub-frames, generates an upper-screen display signal or a lower-screen display signal constituted by a plurality of sub-frame display signals, and sends the display signal to the display module 19.

According to the present image display apparatus, a frame is divided into two sub-frames as described above. The upper-screen time-division gradation conversion block 16 generates a display signal for the first sub-frame from that portion of the input image signal which corresponds to the upper-screen region and which has been selectively transmitted from the upper-screen data selector 14. The upper-screen time-division gradation conversion block 16 generates a display signal for the second sub-frame from that portion of the memory delay image signal which corresponds to the upper-screen region and which has been selectively transmitted from the upper-screen data selector 14. The upper-screen time-division gradation conversion block 16 sends the display signals to the display module 19.

The same is equally true of the lower-screen time-division conversion block 17. That is, the lower-screen time-division gradation conversion block 17 generates a display signal for the first sub-frame from that portion of the input image signal which corresponds to the lower-screen region and which has been selectively transmitted from the lower-screen data selector 15. The lower-screen time-division gradation conversion block 17 generates a display signal for the second sub-frame from that portion of the memory delay image signal which corresponds to the lower-screen region and which has been selectively transmitted from the lower-screen data selector 15. The lower-screen time-division gradation conversion block 17 sends the display signals to the display module 19. Note that the sub-frame process carried out in each of the upper-screen time-division gradation conversion block 16 and the lower-screen time-division conversion block 17 will be described later in detail.

Moreover, the timing controller 13 controls timings at which operations are carried out by the data selectors 14 and 15 and the time-division gradation conversion blocks 16 and 17, as well as a timing at which the memory controller 12 accesses the frame memory 11. The timing controller 13 also functions as a timing control section of the present invention to output upper- and lower-screen control signals that are to be given to the display module 19.

Figure 3:
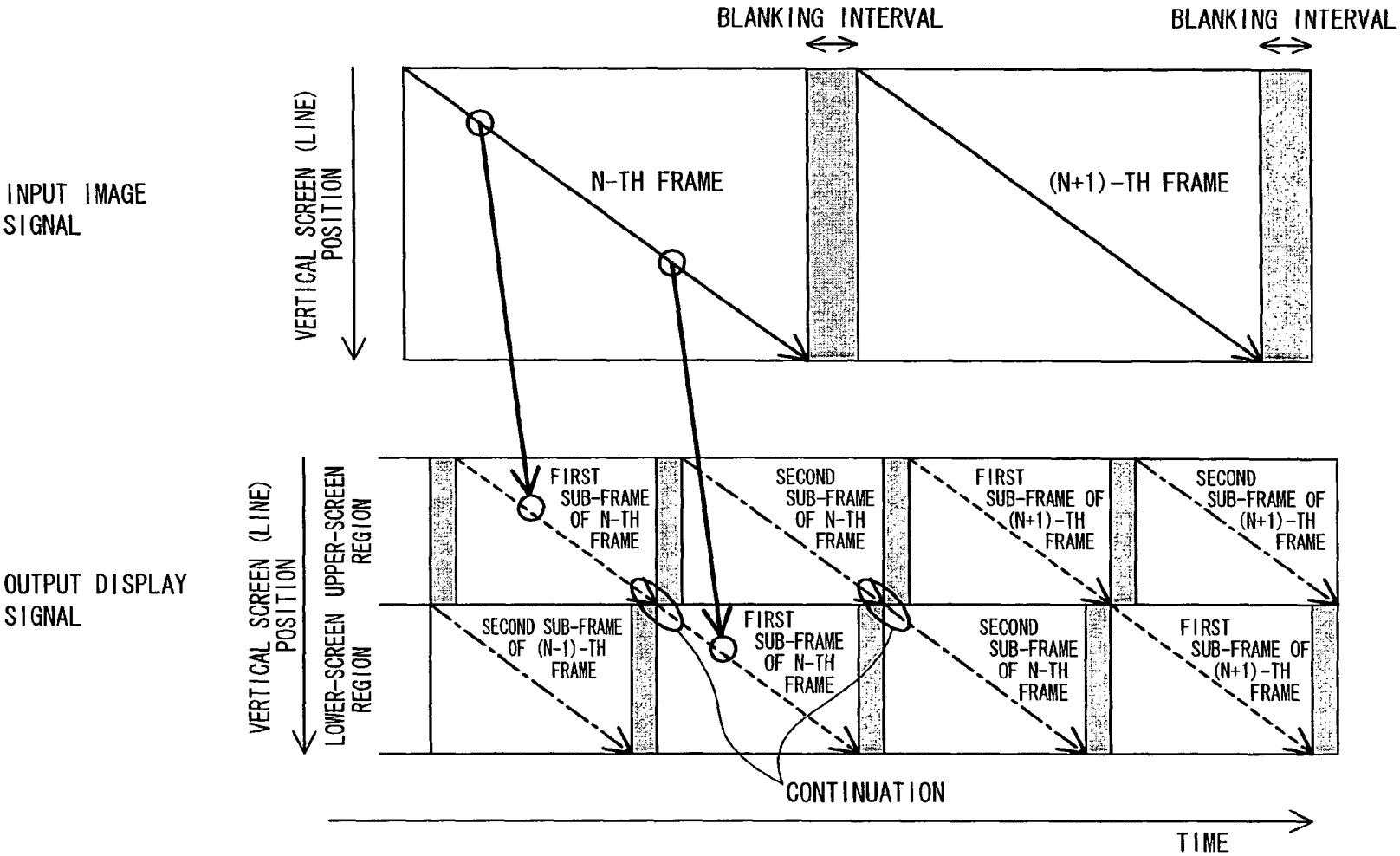
FIG. 3 is a timing chart showing a relationship between (i) an output display signal (an output display signal for an upper screen and an output display signal for a lower screen) that a control device provided in the image display apparatus outputs by processing an input image signal and (ii) the input image signal.
Figure 4:
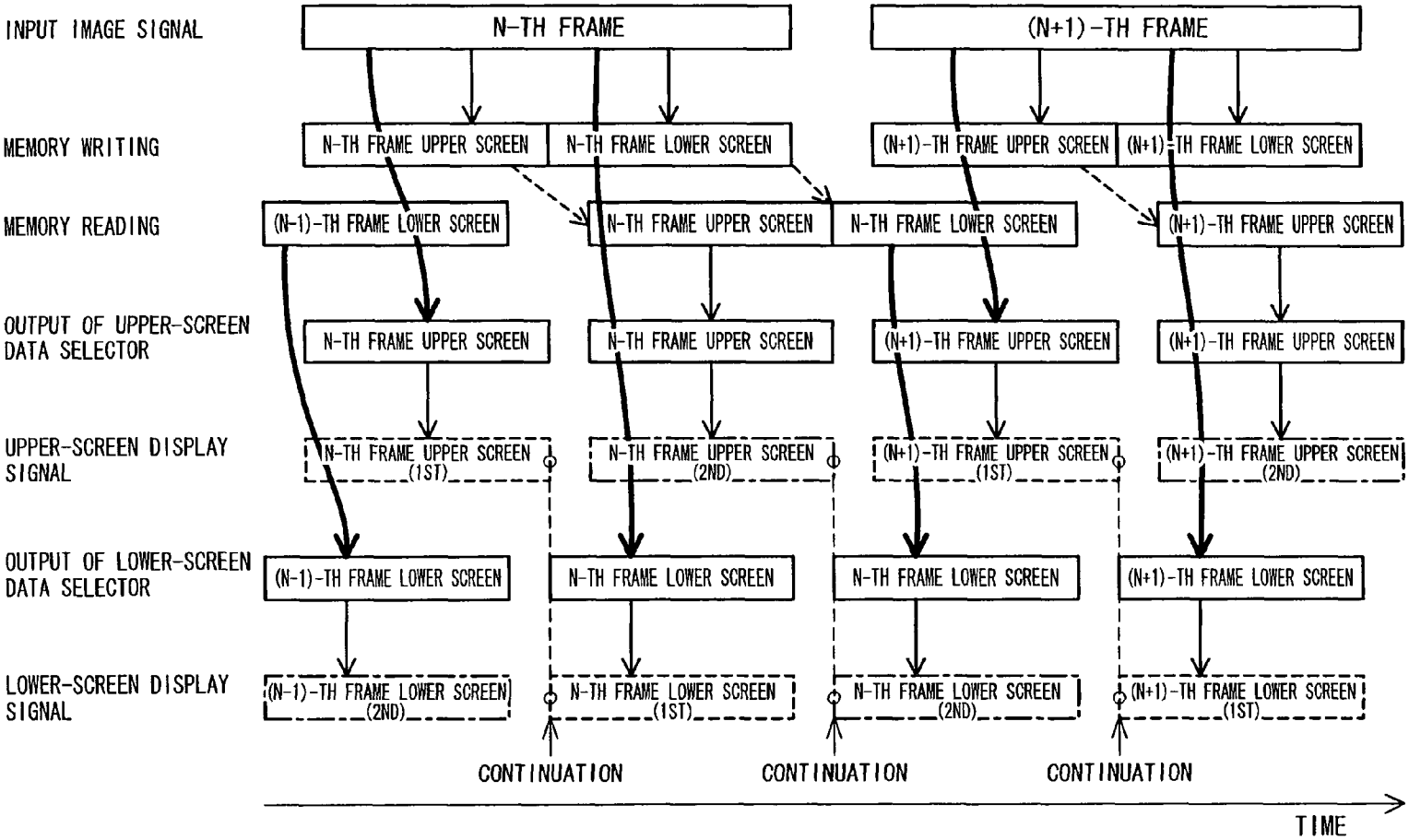
FIG. 4 is a timing chart showing processing timings at which an image signal or a display signal is processed in parts of the control device.

FIG. 3 shows a relationship in terms of time axis between an input image signal inputted into the control device 10 and an output display signal (a display signal for the upper screen and a display signal for the lower screen) outputted from the control device 10. Further, FIG. 4 shows timings at which an image signal or a display signal is processed in the parts of the control device 10.

The present image display apparatus is arranged such that the display screen is divided into the upper-screen region and the lower-screen region that are driven separately. Therefore, as shown in FIG. 3, the transmission frequency of the display signals for the first and second sub-frames is not higher than the transmission frequency of the input image signal. Note that FIG. 3 indicates that the transmission frequency is represented by the slope of an arrow that traverses the vertical screen position within the frame period (excluding a vertical blanking interval) or sub-frame period (excluding a sub-frame vertical blanking interval) and a steeper slope indicates a higher transmission frequency.

This means that while a frame is time-divided into a plurality of sub-frames, the voltage of an image signal is applied to pixels for as long a time as when the frame is not time-divided. This makes it possible to realize a display apparatus in which sufficient pixel charging time can be obtained even when sub-frames into which a frame has been time-divided are driven.

Moreover, the present image display apparatus is arranged such that the upper- and lower-screen regions have the same number of scanning signal lines, and that the number of screen regions into which the display screen is divided is equal to the number of sub-frames. Therefore, the transmission frequency of the input image signal is equal to the transmission frequency of a display signal for each of the sub-frames.

Moreover, as shown in FIG. 3, the control device 10 outputs a display signal for a first sub-frame with respect to each of the upper- and lower-screen regions so that an operation of causing each pixel of the display screen to display an image in the first sub-frame is carried out before half, more preferably 20% in this case, of a frame period of an image signal has elapsed since the image signal was inputted to the pixel, and is driven so that a period of time during which the display signal for the first sub-frame in the upper-screen region is being outputted and a period of time during which the display signal for the first sub-frame in the lower-screen region is being outputted are displaced from each other in accordance with disagreement between points of time at which input image signals for respective screen regions are inputted.

Figure 5:
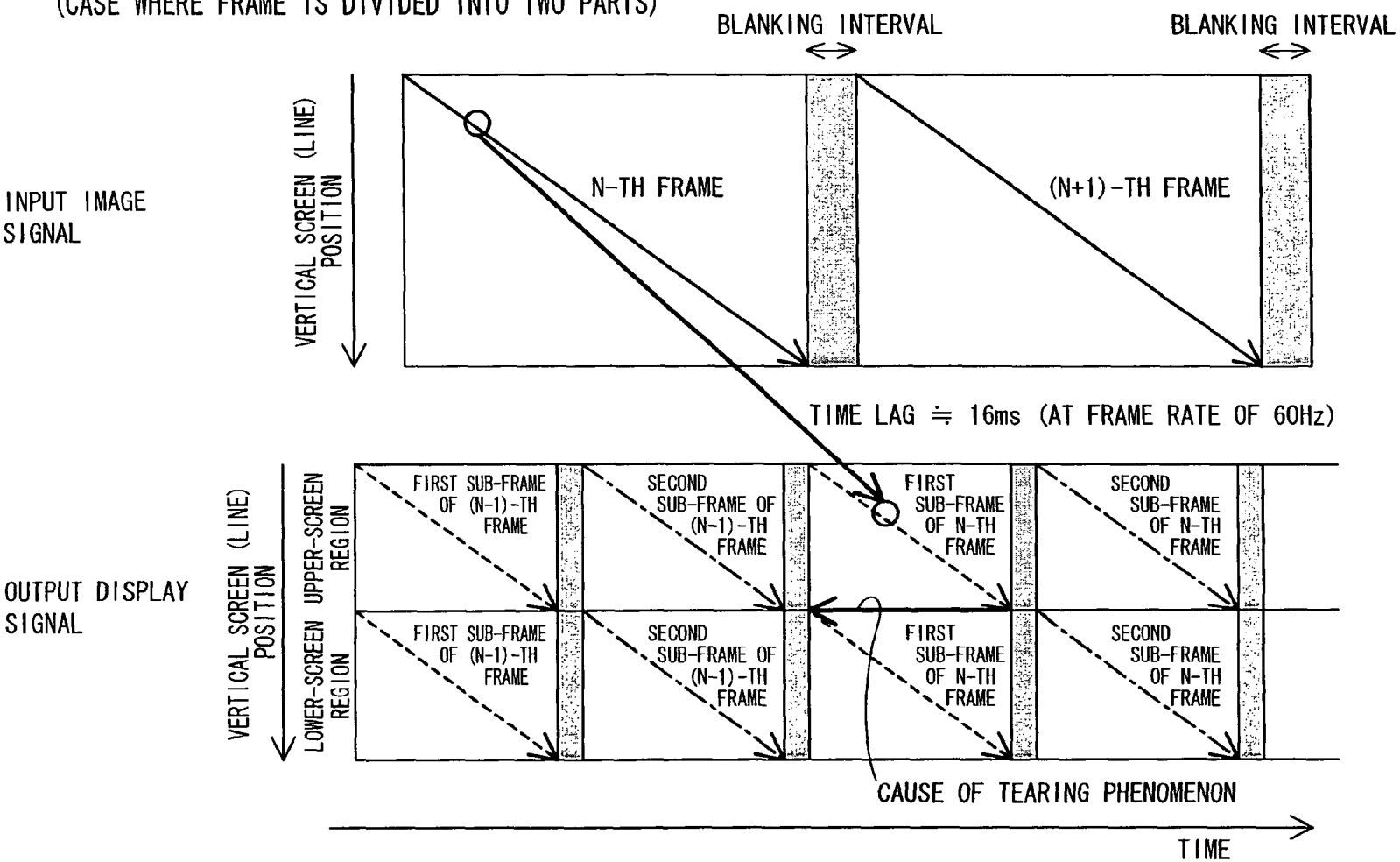
FIG. 5 is a timing chart showing a relationship between (i) an output display signal (an output display signal for an upper screen and an output display signal for a lower screen) that a control device provided in an image display apparatus according to another embodiment outputs by processing an input image signal and (ii) the input image signal.

FIG. 5 shows a relationship in terms of time axis between an input image signal and an output display signal (a display signal for the upper screen and a display signal for the lower screen), which relationship is obtained in cases where a display module divided into two screens is caused to carry out a sub-frame display by simply using two sub-frames.

As shown in FIG. 5, when sub-frame display is simply carried out, the control device 10 outputs a display signal for a first sub-frame of an N-th frame with respect to each of the upper- and lower-screen regions at the timing of completion of input of an image signal, contained in the input image signal transmitted in a time-division manner, which corresponds to the N-th frame, and is driven so that a period of time during which the display signal for the first sub-frame in the upper-screen region is being outputted is equal to a period of time during which the display signal for the first sub-frames in the lower-screen region is being outputted.

Indeed, even such a driving method makes it possible to apply the voltage of an image signal to a pixel for a longer time, and to equalize the transmission frequency of an input image signal and the transmission frequency of a display signal for each sub-frame.

However, in cases where such a driving method is used for a television receiver or the like, there occurs a time lag between a point of time where an image signal is inputted and a point of time where an image is actually displayed in accordance with the image signal, so that disagreement appears between the displayed image and sound corresponding thereto. Further, in cases where such a driving method is used for an image display apparatus of an apparatus, such as a personal computer or a game machine, in which the displayed image needs to be updated immediately in response to an input operation, there occurs a time lag with respect to the operation. This causes deterioration in comfortability in operation.

This is because an operation of causing each pixel of the display screen to display an image in the first sub-frame is carried out after a frame period of an image signal has elapsed since the image signal was inputted to the pixel. In cases where the vertical frequency of the input image signal is 60 Hz, the time lag is approximately 16 ms.

On the other hand, the present image display apparatus is arranged such that an operation of causing each pixel of the display screen to display an image in the first sub-frame is carried out before half, more preferably 20%, of a frame period of an image signal has elapsed since the image signal was inputted to the pixel.

This causes a reduction in period between a point of time where an image signal corresponding to a frame is inputted and a point of time where an image corresponding to the frame is displayed by the display module. Therefore, even when the present image display apparatus is used as a television receiver, there occurs no problem of a time lag between a point of time where an image signal is inputted and a point of time where an image is actually displayed in accordance with the image signal. Further, also in cases where the present image display apparatus is used as an image display apparatus of an apparatus, such as a personal computer or a game machine, in which the displayed image needs to be updated immediately in response to an input operation, it is possible to carry out an image display that is less affected by a time lag in response to an operation.

Specifically, according to the control device 10, in cases where the frame frequency (vertical frequency) of an incoming image signal is 60 Hz, an operation of causing each pixel of the display screen to display an image in the first sub-frame is carried out before 3.3 ms has elapsed since the image signal was inputted to the pixel.

Incidentally, such a driving method as shown in FIG. 5, i.e., such a driving method that a period of time during which a display signal for a first sub-frame in an upper-screen region is being outputted is equal to a period of time during which a display signal for a first sub-frame in a lower-screen region is being outputted suffers from the following problems in addition to the time lag problem.

Figure 6:
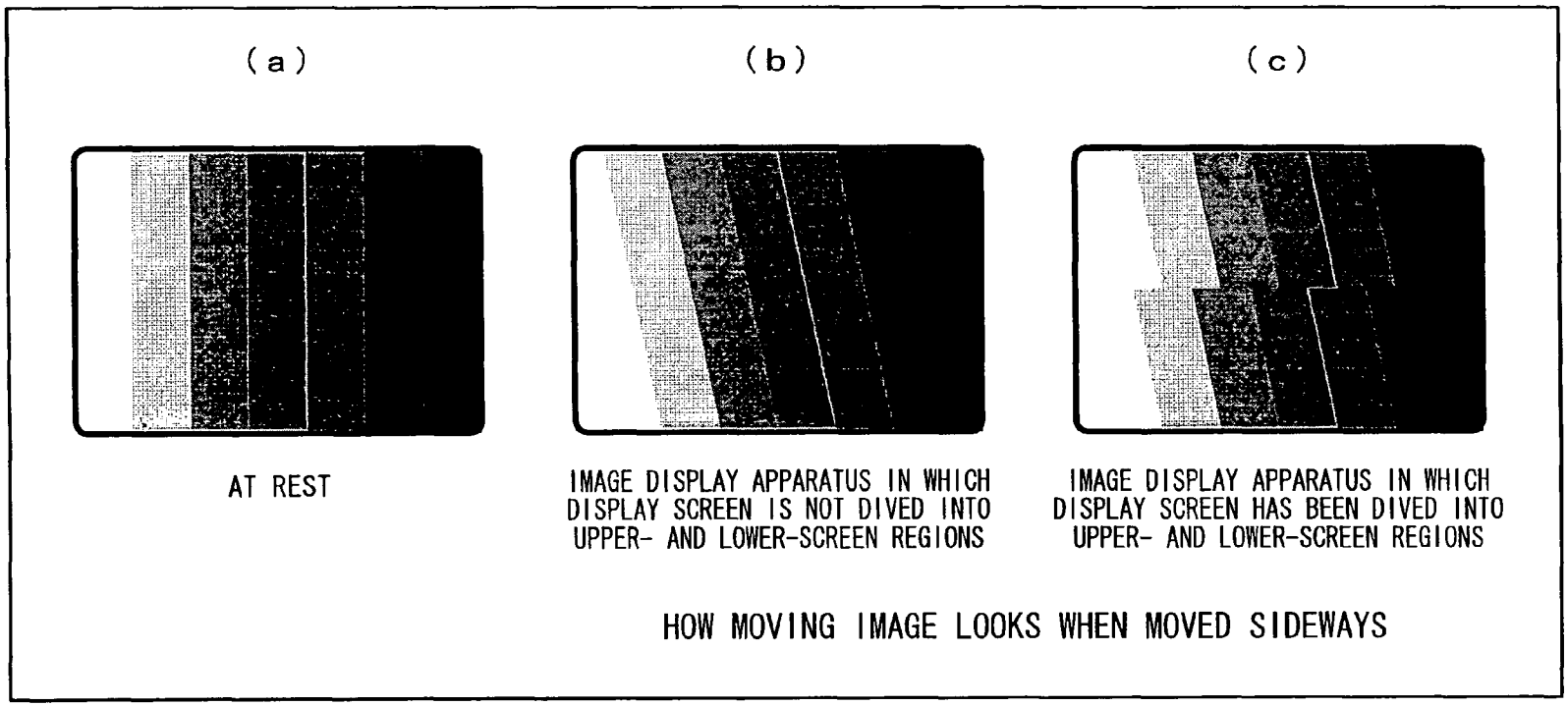
FIGS. 6(*a*) through 6(*c*) are explanatory diagrams illustrating that the display quality of a moving image is degraded due to the occurrence of a tearing phenomenon.

One of the problems is that the occurrence of a tearing phenomenon causes deterioration in display quality of a moving image. That is, in cases where such a still image as shown in FIG. 6(*a*) is moved sideways, the still image looks as in FIG. 6(*b*) in cases where the display screen is not divided into upper and lower parts, but the still image looks as in FIG. 6(*c*)

by being divided at a boundary portion between the screen regions divided from each other (tearing phenomenon).

An image signal, corresponding to one frame, which is stored in the frame memory 11 needs to be saved until a display signal corresponding to the last sub-frame is prepared. Therefore, in cases where the timing of an image display of an identical sub-frame is equal between the upper-screen region and the lower-screen region, the upper-screen region and the lower-screen region cannot share a memory region of the frame memory 11. According to the driving method of FIG. 5, the previously written image signal of the N-th frame needs to be read out (twice) while an image signal of an (N+1)-th frame is written. This necessitates memory capacity corresponding to two screens (two frames) for use in storage and reading.

Furthermore, all display signals respectively corresponding to all sub-frames are prepared by reading out the image signal stored in the frame memory 11. This causes an increase in the number of times the frame memory 11 is accessed and an increase in the memory bandwidth required of the frame memory 11. According to the driving method of FIG. 5, one input screen is written while two output screens are read out twice as fast, so that the memory bandwidth is FD+(2F) D*2=5FD(bps), where F (Hz) is the transmission frequency of an input image signal and D is the number of data bits per pixel.

On the other hand, according to the present image display apparatus, as shown in FIG. 3, the period of time during which a display signal is being outputted for each of the first and second sub-frames varies between the upper-screen region and the lower-screen region; that is, the timing of a display operation of each sub-frame of the same stage varies between the upper-screen region and the lower-screen region. Moreover, an operation of displaying an image in each sub-frame of a given stage in the upper-screen region (uppermost screen region) precedes an operation of displaying an image in each sub-frame of the same stage in the lower-screen region. Therefore, a moving image is displayed with no tearing phenomenon being accentuated, so that the moving image can be improved in display quality.

Moreover, since the timing of an image display of each sub-frame of the same stage varies between the screen regions as described above, it is possible to reduce the amount of memory required of the frame memory 11 in which the image signal is stored. That is, the image signal needs to be stored in the frame memory 11 until a display signal is prepared for the second sub-frame serving as the last stage. For this reason, in cases where the timing of an image display of each sub-frame of the same stage is equal between the screen regions, it becomes necessary that all image signals corresponding to one frame be stored in the memory.

On the other hand, since the timing of an image display of each sub-frame of the same stage varies between the screen regions as described above, a display signal for the second sub-frame serving as the last stage is prepared for each of the screen regions. This makes it possible to share the memory region of the frame memory 11 between the screen regions. For example, after a display signal has been generated for a second sub-frame for use in the upper-screen region, an incoming image signal for use in the lower screen is stored in a memory region assigned to the upper screen.

In cases where a memory region is shared, the amount of memory that is used in the frame memory in displaying a one-frame still image corresponding to the image signal depends on the number of regions into which the display screen is divided and the number of sub-frames and slightly varies depending on the length of a blanking interval. However, in cases where each of the number of regions into which the display screen is divided and the number of sub-frames is N, the amount of memory corresponds to approximately (N−1)/N frames. In this description, since each of the number of regions into which the display screen is divided and the number of sub-frames is 2, the amount of memory corresponds to 0.5 frames plus a vertical blanking interval of a sub-frame.

According to the present display apparatus, when a display signal has been generated for a second sub-frame corresponding to the upper-screen region, the memory controller 12 writes, in a memory region in which an image signal corresponding to the upper-screen region was stored, an incoming image signal corresponding to the lower-screen region.

With this, the capacity of address space of the frame memory 11 which address space is used in displaying a one-frame still image corresponding to the image signal is not less than 50% of one screen and less than one screen. This leaves more space in the memory capacity, so that another function (e.g., overshoot driving for improving performance of response to a moving image) is added by utilizing available address space of the memory.

Furthermore, by making use of the fact that the transmission frequency of the input image signal is equal to the transmission frequency of a display signal for each sub-frame, the control device 10 causes the input image signal to branch off into the upper-screen data selector 14 and the lower-screen data selector 15, so that a display signal for a first sub-frame in each of the screen regions is generated by using this input image signal and that only a display signal for a second sub-frame in each of the screen regions is generated by reading out the image signal stored in the frame memory 11.

Therefore, the number of times the frame memory 11 is accessed is reduced, so that the memory bandwidth required of the frame memory 11 can be reduced. Specifically, one input screen is written while one output screen is read out, so that the memory bandwidth is FD+FD=2FD(bps), where F (Hz) is the transmission frequency of an input image signal and D is the number of data bits per pixel.

Furthermore, the control device 10 carries out control such that an operation of causing each pixel of the display screen to display an image in each sub-frame of the same stage is carried out after a certain period of time has elapsed since an image signal was inputted to the pixel. With this, as indicated by circles in FIGS. 3 and 4, the output of a display signal (1st) for a first sub-frame in the lower screen is started at the timing of completion of output of a display signal (1st) for a first sub-frame in the upper screen, and the output of a display signal (2nd) for a second sub-frame in the lower screen is similarly started at the timing of completion of output of a display signal (2nd) for a second sub-frame in the upper screen, so that the displayed image continues both in terms of time and position at the boundary between the screen regions. Therefore, a moving image is displayed with no tearing phenomenon occurring, so that the moving image can be improved in display quality.

Deterioration in quality of a moving image due to a tearing phenomenon is limited as long as the delay between the completion of output of a display signal for a sub-frame in the upper-screen region and the start of output of a display signal for the sub-frame in the lower-screen region is less than 18%, or more preferably less than 5%, of one frame period, although the aforementioned arrangement is more preferable.

When an operation of displaying an image in each sub-frame of a given frame in an upper one of the screen regions precedes an operation of displaying an image in each frame of the same frame in a lower one of the screen regions, a control signal may be generated such that, in a given sub-frame, with respect to the delay between a point of time where an image signal is inputted to each horizontal line of a first screen region of the display screen and a point of time where an operation of causing the horizontal line to display an image is carried out, the delay between a point of time where an image signal is inputted to each horizontal line of a second screen region, situated next to the first screen region, which displays an image after the first screen region has displayed an image and a point of time where an image display operation is carried out is equal or longer by 18%, or more preferably 5%, of one frame period.

Further, the present image display apparatus is compatible with two types of input frame frequency: 60 Hz and 50 Hz. The control device 10 changes, in accordance with a change in frame frequency of an input (i.e., a change in length of one frame period), a period of time between the input of an image signal to each horizontal line and a display operation of the second sub-frame, thereby carrying out control such that the length of a display period of the first sub-frame is equal to the length of a display period of the second sub-frame.

For this purpose, in the control device 10, a vertical blanking interval of a display signal for each sub-frame of each screen region is set to be a fraction obtained by dividing a vertical blanking interval of the incoming image signal by the number of sub-frames, i.e., ½.

With this, the period between a point of time where an operation of displaying an image in each sub-frame is carried out and a point of time where the image displayed in the sub-frame is rewritten by an operation of displaying an image in the next sub-frame, i.e., the actual sub-frame display period is equal between two sub-frames.

By equalizing a plurality of sub-frame display periods, even in cases where the length of one frame period has been changed due to a change in frame frequency of an input, there is no change in time ratio of one sub-frame period to another within one frame period, so that there is no change in time integral amount of display luminance in one frame period for each sub-frame. This makes it possible to share a gradation conversion value for each sub-frame regardless of the frame frequency, thereby reducing the cost of the time-division gradation conversion blocks 16 and 17.

Depending on the response performance of the display module, it is conceivable that sub-frame periods are not equalized in length so that an effect of remedying image blur is improved. In this case, although the cost is increased, a gradation conversion value corresponding to the input frame frequency is prepared. The present invention is not limited to a case where sub-frame periods are equalized.

Meanwhile, depending on an external input apparatus, such as a tuner section of a television receiver or a personal computer, which is connected to the present image display apparatus, there may be a fluctuation in length of an input one frame period. For example, an input one frame with the standard total number of lines T may randomly fluctuate between T−3 and T+3. Such a change in input one frame period can be handled by always finely adjusting the length of each sub-frame period in accordance with the total number of lines of the input one frame. However, this causes an increase in cost of the control device 10.

In view of this, according to the present image display apparatus, the delay between a point of time where an image signal is inputted to each horizontal line of the display screen and a point of an operation of causing the horizontal line to display an image is carried out (i) is not changed in a first sub-frame, i.e., the first stage even in cases where the length of one frame period of the incoming image signal is changed, (ii) is not changed in a second sub-frame (a sub-frame subsequent to the first stage) in cases where the length is changed by less than a predetermined reference value, and (iii) is changed in a second sub-frame in cases where the length is changed by not less than the reference value.

With this, even when an input one frame with the standard total number of lines T randomly fluctuates between T−3 and T+3, the time between the input of an image signal to each horizontal line and an display operation of each horizontal line of the second sub-frame is set with reference to the standard total number of lines T and is not changed. This makes it possible to avoid an increase in cost of the control device 10.

As described above, the present image display apparatus is compatible with two types of input frame frequency: 60 Hz and 50 Hz. Therefore, the control device 10 includes a reference value T1 for 60 Hz and a reference value for 50 Hz as a reference value for the total number of lines of an input one frame.

The following explains a sub-frame process carried out in the time-division gradation conversion blocks 16 and 17 provided in the control device 10.

Although not particularly shown, each of the upper-screen time-division gradation conversion block 16 and the lower-screen time-division gradation conversion block 17 includes (i) a first LUT (look-up table) serving as a correspondence table for converting an image signal into a display signal for a first sub-frame and (ii) a second LUT serving as a correspondence table for converting an image signal into a display signal for a second sub-frame.

The values stored in each of the first and second LUTs are set in the following manner. The following shows an example in which a display signal for the second sub-frame is set to exhibit higher luminance than a display signal for the first sub-frame does. However, the opposite may be true.

That is, in cases where the gradation of an image signal indicates a gradation not more than a predetermined threshold value (a luminance not higher than the luminance indicated by the threshold value), the value of a display signal for the first sub-frame is set to be a value falling within a range predetermined for a dark display, and the value of a display signal for the second sub-frame is set to be a value corresponding to the value of the display signal for the first sub-frame and the gradation value of the image signal. The range for a dark display contains gradations not more than a gradation predetermined for dark display, and contains a gradation (black) indicative of the minimum luminance in cases where the gradation predetermined for a dark display indicates the minimum luminance.

On the other hand, in cases where the gradation of an image signal indicates a gradation more than a predetermined threshold value (a luminance higher than the luminance indicated by the threshold value), the value of a display signal for the second sub-frame is set to be a value falling within a range predetermined for a bright display, and the value of a display signal for the first sub-frame is set to be a value corresponding to the value of the display signal for the second sub-frame and the gradation of the image signal. The range for a bright display contains gradations not less than a gradation predetermined for a bright display, and contains a gradation (white) indicative of the maximum luminance in cases where the gradation predetermined for a bright display indicates the maximum luminance.

Figure 7:
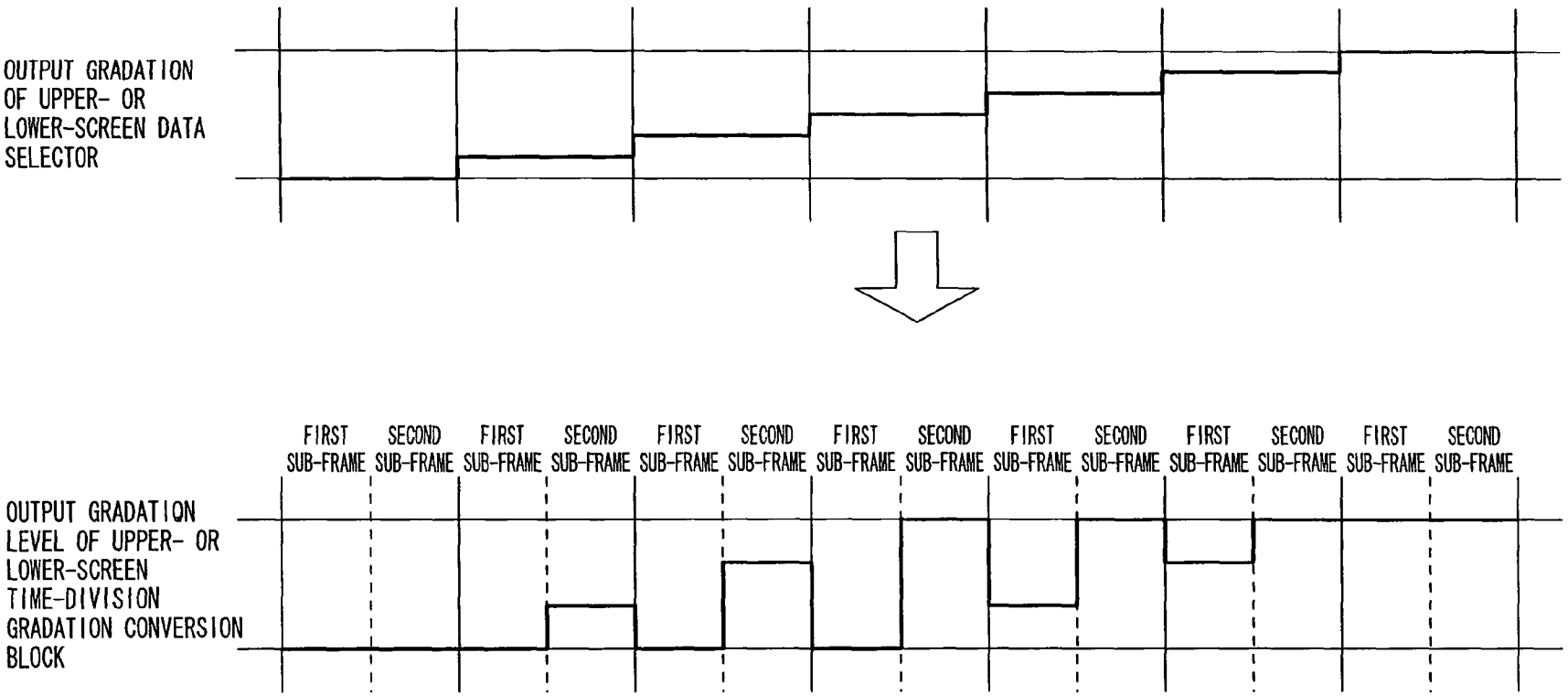
FIG. 7 is a diagram showing a relationship between an input gradation level and an output gradation level in an image display apparatus in which time-division driving is carried out.

FIG. 7 shows an example in which display gradations are obtained for first and second sub-frames in accordance with the gradation of an image signal inputted to such an upper- or lower-screen time-division gradation conversion block 16 or 17 as described above.

In cases where the gradation level of an input image signal is high, the gradation level of the input image signal is allocated to both of the sub-frames. On this occasion, the maximum difference between the luminance integral value obtained when the input gradation level is highest and the luminance integral value obtained when the input gradation level is lowest is secured. Further, in order to obtain an impulse while avoiding a reduction in contrast ratio, if at all possible, a high output gradation level is allocated to the second sub-frame and a low output gradation level is allocated to the first sub-frame.

As a result, in cases where an image signal for a given pixel in a given frame indicates a gradation not more than the threshold value, i.e., in a low-luminance region, the level of luminance of the pixel in the frame is controlled primarily in accordance with the size of the value of the display signal for the second sub-frame.

Therefore, the display state of the pixel can be made to be a dark display state in that period of the frame which corresponds to at least the first sub-frame. With this, when the gradation of an image signal in a given frame indicates the gradation of a low-luminance region, the light-emitting state of a pixel in the frame can be made similar to impulse light emission such as that seen in a CRT (cathode-ray tube). This makes it possible to improve the quality of a moving image displayed by the pixel array 20.

The reason why an effect of preventing moving image blur is obtained by means of pseudo-impulse driving will be briefly described below with reference to FIGS. 8(*a*) and 8(*b*).

Figure 8:
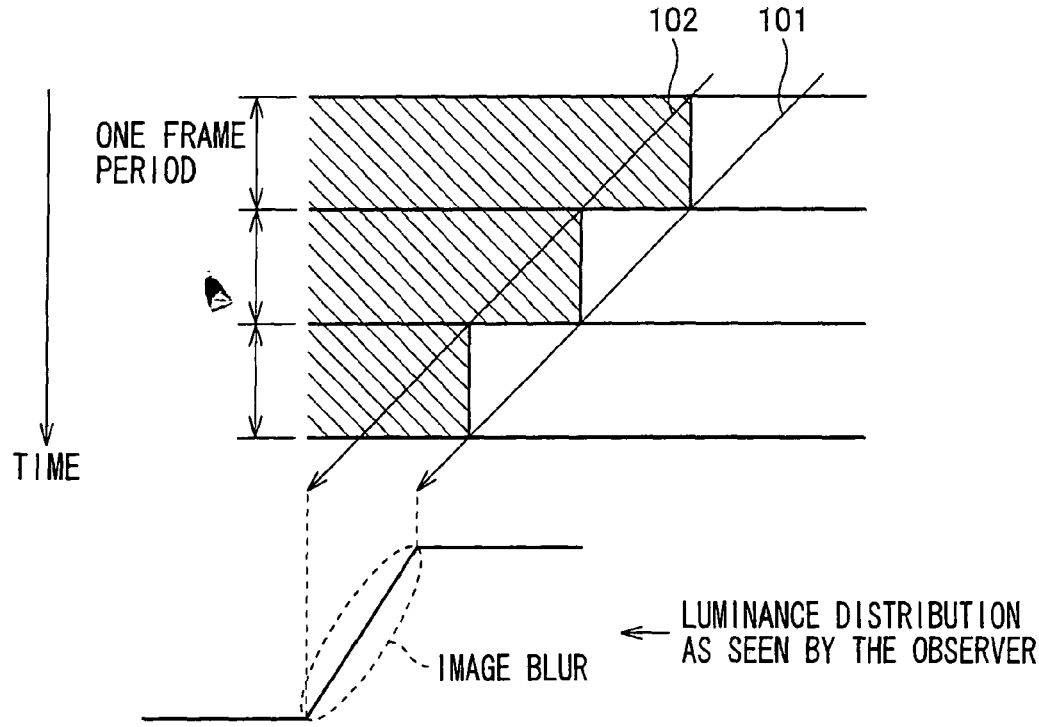
FIG. 8(*a*) is a diagram showing how a boundary between two regions of different luminance moves at the time of hold driving.
Figure 8:
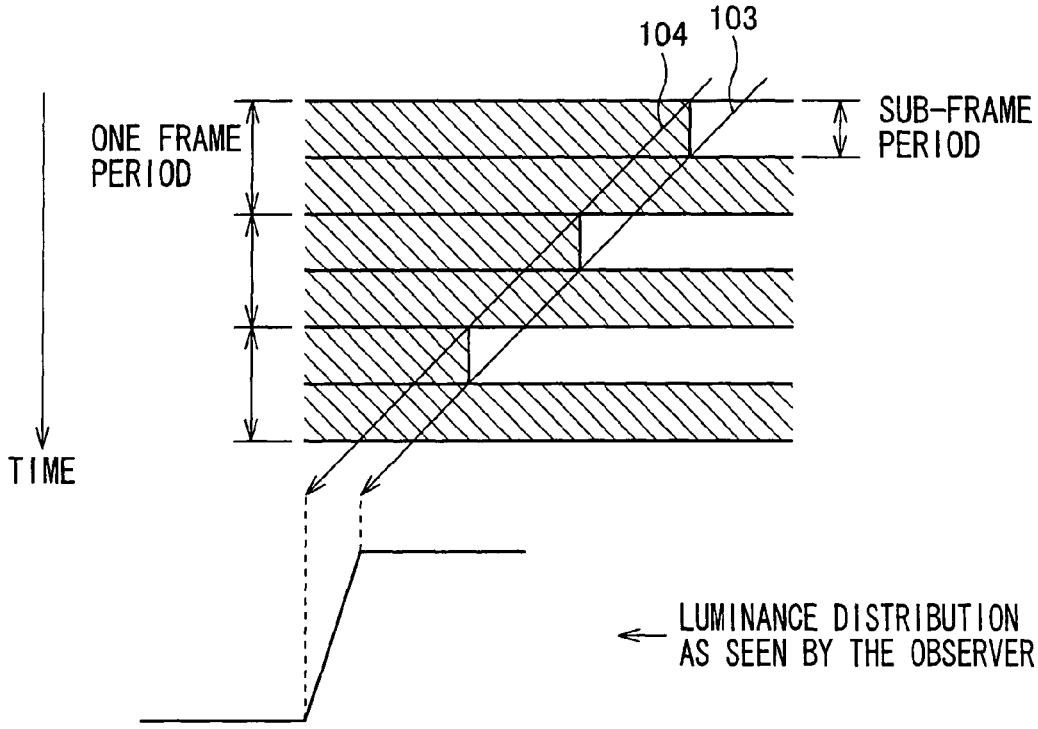

FIG. 8(*a*) is a diagram showing how a boundary between two regions of different display luminance moves at the time of hold driving. The vertical axis represents time; the horizontal axis represents location. Similarly, FIG. 8(*b*) is a diagram showing how a boundary between two regions of different display luminance moves at the time of pseudo-impulse driving. In FIG. 8(*b*), which shows pseudo-impulse driving, one frame is equally divided into two sub-frames at a ratio of 1:1.

In cases where the boundary moves in this way, the line of sight of the observer moves in accordance with the movement of the boundary. That is, in FIG. 8(*a*), the line of sight of the observer is represented by arrows 101 and 102. Moreover, a luminance distribution as seen by the observer in the vicinity of the boundary is obtained by time-integrating the display luminance in accordance with the movement of the line of sight. For this reason, in FIG. 8(*a*), a region located on the left side of the arrow 101 is perceived to be as luminous as a region located on the left side of the boundary, and a region located on the right side of the arrow 102 is perceived to be as luminous as a region located on the right side of the boundary. Meanwhile, a region located between the arrows 101 and 102 is perceived as if the luminance gradually increased. It is this portion that is recognized as image blur.

Similarly, in the case of pseudo-impulse driving shown in FIG. 8(*b*), according to the luminance distribution as seen by the observer in the vicinity of the boundary, image blur occurs in a region located between arrows 103 and 104. However, the slope is steeper than in the case of hold driving shown in FIG. 8(*a*). This shows that the image blur is reduced.

Further, the gradation of an image signal to be sent to a pixel in a given frame indicates a gradation higher than the threshold value, i.e., in a high-luminance region, the level of luminance of the pixel in the frame is controlled primarily in accordance with the size of the value of the display signal for the first sub-frame. Therefore, as compared with the arrangement in which luminance is substantially equally allocated to the first and second sub-frames, the difference between the luminance of a pixel in the first sub-frame and the luminance of the pixel in the second sub-frame can be set to be great. As a result, even when the gradation of an image signal in a frame indicates the gradation of a high-luminance range, the light-emitting state of a pixel in the frame can be almost always made similar to impulse light emission. This makes it possible to improve the quality of a moving image displayed by the pixel array 20.

Furthermore, according to the foregoing arrangement, when the gradation of the image signal indicates the gradation of a high-luminance region, the display signal for the second sub-frame has a value falling within a range predetermined for a bright display. As the gradation indicated by the image signal increases, the value of the display signal for the first sub-frame is increases. Therefore, as compared with the arrangement in which a period of a dark display is necessarily provided even when an instruction for a white display is given, the luminance of a pixel in the frame can be made higher. As a result, the light-emitting state of the pixel is made similar to the impulse light emission. This makes it possible to realize a brighter display apparatus in which the maximum value of luminance of a pixel can be greatly increased while improving the quality of a moving image being displayed.

Note that the present embodiment carries out time-division gradation conversion for the purpose of reducing moving-image blur by carrying out impulse driving. However, the present invention is not limited in terms of a gradation conversion method, and can be applied to all types of image display apparatus in which display driving is carried out by time-dividing one frame of an input into a plurality of sub-frames.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

As described above, a display apparatus of the present invention is a display apparatus for, by time-dividing a single frame into a plurality of sub-frames and by displaying, in a single frame period, images respectively corresponding to the plurality of sub-frames, displaying an image corresponding to the single frame, including: a display module having a display screen divided into a plurality of screen regions in each of which an image is able to be independently displayed; and control means for controlling an image display operation of the display module, the control means including (i) a signal division section for dividing an incoming image signal in accordance with the screen regions of the display module and (ii) a signal generation section for generating a display signal for each of the plurality of sub-frames from the incoming image signal. Note that the signal generation section generates a display signal for each of a plurality of sub-frames with the intention of remedying moving-image blur.

According to the foregoing arrangement, a display module having a display screen divided in a vertical direction into a plurality of screen regions in each of which an image can be independently displayed is used in carrying out such a sub-frame display that an image corresponding to a single frame is displayed by time-dividing the single frame into a plurality of sub-frames and by displaying a plurality of images respectively corresponding to the sub-frames. Therefore, even if a sub-frame display is carried out, the voltage of an image signal can be applied to a pixel for a longer time so as to be sufficiently applied to the pixel.

This brings about an effect of making it possible to provide an image display apparatus in which sufficient pixel charging time can be obtained even when sub-frames into which a frame has been time-divided are driven.

Therefore, the present invention can be widely and suitably applied as a driving device for use in various display apparatuses such as liquid crystal television receivers and liquid crystal monitors.

The invention claimed is:

1. A display apparatus for, by time-dividing a single frame into a plurality of sub-frames and by displaying, in a single frame period, images respectively corresponding to the plurality of sub-frames, displaying an image corresponding to the single frame, comprising:

a display module having a display screen divided into a plurality of screen regions in each of which an image is able to be independently displayed; and a control device configured to control an image display operation of the display module, wherein the control device including (i) a signal division section for dividing an incoming image signal in accordance with the screen regions of the display module and (ii) a signal generation section for generating a display signal for each of the plurality of sub-frames from the incoming image signal, the number of screen regions into which the display screen has been divided is equal to the number of sub-frames, the control device further includes a timing control section for generating a control signal for controlling an image display operation of each of the sub-frames, the timing control section generating a control signal so that timing of an image display operation of each sub-frame of an identical stage varies between the screen regions in such a manner that an image display operation of each sub-frame of a given stage in an upper one of the screen regions precedes an image display operation of each sub-frame of the same stage in a lower one of the screen regions, and the timing control section generates a control signal so that, in a given sub-frame, with respect to a delay between (i) a point of time where an image signal is inputted to each horizontal line of a first screen region of the display screen and (ii) a point of time where an operation of causing the horizontal line to display an image is carried out, a delay between (a) a point of time where an image signal is inputted to each horizontal line of a second screen region, situated next to the first screen region, which displays an image after the first screen region has displayed an image and (b) a point of time where an image display operation is carried out is equal or longer by less than 18% of one frame period.

2. The display apparatus as set forth in claim 1, wherein the display screen is equally divided.

3. The display apparatus as set forth in claim 1, wherein the length of a period corresponding to one of the sub-frames is equal to the length of a period corresponding to another one of the sub-frames.

4. The display apparatus as set forth in claim 1, wherein the length of a single horizontal scanning period in the display module is equal to the length of a single horizontal scanning period of the incoming image signal.

5. The display apparatus as set forth in claim 1, wherein each of the number of screen regions into which the display screen has been divided and the number of sub-frames is 2.

6. The display apparatus as set forth in claim 1, wherein the control device further includes a timing control section for generating a control signal for controlling an image display operation of each of the sub-frames, the timing control section generating a control signal so that an operation of causing each pixel of the display screen to display an image in a first sub-frame is carried out before half of a frame period of an image signal has elapsed since the image signal was inputted to the pixel.

7. The display apparatus as set forth in claim 1, wherein the control device further includes a timing control section for generating a control signal for controlling an image display operation of each of the sub-frames, the timing control section generating a control signal so that an operation of causing each pixel of the display screen to display an image in a first sub-frame is carried out before 20% of a frame period of an image signal has elapsed since the image signal was inputted to the pixel.

8. The display apparatus as set forth in claim 1, wherein the timing control section generates a control signal so that an operation of causing each horizontal line of the display screen to display an image is carried out after a certain period of time has elapsed since an image signal was inputted to the horizontal line.

9. The display apparatus as set forth in claim 1, wherein the timing control section generates a control signal so that, in a given sub-frame, with respect to a delay between (i) a point of time where an image signal is inputted to each horizontal line of a first screen region of the display screen and (ii) a point of time where an operation of causing the horizontal line to display an image is carried out, a delay between (a) a point of time where an image signal is inputted to each horizontal line of a second screen region, situated next to the first screen region, which displays an image after the first screen region has displayed an image and (ii) a point of time where an image display operation is carried out is equal or longer by less than 5% of one frame period.

10. The display apparatus as set forth in claim 1, wherein the timing control section changes a delay between a point of time where an image signal is inputted to each horizontal line of the display screen and a point of time where an operation of causing the horizontal line to display an image is carried out, so that the delay (i) is not changed in a first sub-frame even when the length of a single frame period of the incoming image signal is changed, (ii) is not changed in a subsequent sub-frame when the length is changed by less than a predetermined reference value, and (iii) is changed in a subsequent sub-frame when the length is changed by not less than the reference value.

11. The display apparatus as set forth in claim 1, wherein the capacity of address space, contained in a frame memory in which the incoming image signal is stored, which is used in displaying a one-frame still image corresponding to the image signal corresponds to not less than 50% of one screen and less than one screen.

12. The display apparatus as set forth in claim 1, wherein the control device further includes a memory control section for controlling writing and reading of a frame memory in which the incoming image signal is stored, when a display signal is generated for a last sub-frame corresponding to a screen region, the memory control section writes, in a region of the frame memory in which region an image signal corresponding to the screen region was stored, an incoming image signal corresponding to another screen region.

13. The display apparatus as set forth in claim 1, wherein the signal generation section generates a display signal for each sub-frame subsequent to a first sub-frame by using an image signal read out from a frame memory in which the incoming image signal is stored, and generates a display signal for the first sub-frame by directly using the incoming image signal without reading any image signal from the frame memory.

14. The display apparatus as set forth in claim 1, wherein a vertical blanking interval of a display signal for each sub-frame in each screen region corresponds to a fraction obtained by dividing a vertical blanking interval of the incoming image signal by the number of sub-frames.

15. The display apparatus as set forth in claim 1, further comprising:

a receiving device configured to receive a television broadcast, which inputs, to the control device of the display apparatus, an image signal indicating an image transmitted by the television broadcast, wherein:

the display module is a liquid crystal display module; and the display apparatus operates as a liquid crystal television receiver.

16. The display apparatus as set forth in claim 1, wherein:

the display module is a liquid crystal display module; and the control device receives an external image signal; and the display apparatus operates as a liquid crystal monitor apparatus that displays an image indicated by the image signal.

17. A display apparatus for, by time-dividing a single frame into a plurality of sub-frames and by displaying, in a single frame period, images respectively corresponding to the plurality of sub-frames, displaying an image corresponding to the single frame, comprising:

a display module having a display screen divided into a plurality of screen regions in each of which an image is able to be independently displayed; and a control device configured to control an image display operation of the display module, wherein the control device including (i) a signal division section for dividing an incoming image signal in accordance with the screen regions of the display module and (ii) a signal generation section for generating a display signal for each of the plurality of sub-frames from the incoming image signal, the number of screen regions into which the display screen has been divided is equal to the number of sub-frames, the control device further includes a timing control section for generating a control signal for controlling an image display operation of each of the sub-frames, the timing control section generating a control signal so that timing of an image display operation of each sub-frame of an identical stage varies between the screen regions in such a manner that an image display operation of each sub-frame of a given stage in an upper one of the screen regions precedes an image display operation of each sub-frame of the same stage in a lower one of the screen regions, and the timing control section changes a delay between a point of time where an image signal is inputted to each horizontal line of the display screen and a point of time where an operation of causing the horizontal line to display an image is carried out, so that the delay (i) is not changed in a first sub-frame even when the length of a single frame period of the incoming image signal is changed, (ii) is not changed in a subsequent sub-frame when the length is changed by less than a predetermined reference value, and (iii) is changed in a subsequent sub-frame when the length is changed by not less than the reference value.

18. The display apparatus as set forth in claim 17, wherein the display screen is equally divided.

19. The display apparatus as set forth in claim 17, wherein the length of a period corresponding to one of the sub-frames is equal to the length of a period corresponding to another one of the sub-frames.

20. The display apparatus as set forth in claim 17, wherein the length of a single horizontal scanning period in the display module is equal to the length of a single horizontal scanning period of the incoming image signal.

21. The display apparatus as set forth in claim 17, wherein each of the number of screen regions into which the display screen has been divided and the number of sub-frames is 2.

22. The display apparatus as set forth in claim 17, wherein the control device further includes a timing control section for generating a control signal for controlling an image display operation of each of the sub-frames, the timing control section generating a control signal so that an operation of causing each pixel of the display screen to display an image in a first sub-frame is carried out before half of a frame period of an image signal has elapsed since the image signal was inputted to the pixel.

23. The display apparatus as set forth in claim 17, wherein the control device further includes a timing control section for generating a control signal for controlling an image display operation of each of the sub-frames, the timing control section generating a control signal so that an operation of causing each pixel of the display screen to display an image in a first sub-frame is carried out before 20% of a frame period of an image signal has elapsed since the image signal was inputted to the pixel.

24. The display apparatus as set forth in claim 17, wherein the timing control section generates a control signal so that an operation of causing each horizontal line of the display screen to display an image is carried out after a certain period of time has elapsed since an image signal was inputted to the horizontal line.

25. The display apparatus as set forth in claim 17, wherein the signal generation section generates a display signal for each sub-frame subsequent to a first sub-frame by using an image signal read out from a frame memory in which the incoming image signal is stored, and generates a display signal for the first sub-frame by directly using the incoming image signal without reading any image signal from the frame memory.

26. The display apparatus as set forth in claim 17, wherein a vertical blanking interval of a display signal for each sub-frame in each screen region corresponds to a fraction obtained by dividing a vertical blanking interval of the incoming image signal by the number of sub-frames.

27. The display apparatus as set forth in claim 17, wherein the timing control section generates a control signal so that, in a given sub-frame, with respect to a delay between (i) a point of time where an image signal is inputted to each horizontal line of a first screen region of the display screen and (ii) a point of time where an operation of causing the horizontal line to display an image is carried out, a delay between (a) a point of time where an image signal is inputted to each horizontal line of a second screen region, situated next to the first screen region, which displays an image after the first screen region has displayed an image and (ii) a point of time where an image display operation is carried out is equal or longer by less than 5% of one frame period.

28. The display apparatus as set forth in claim 17, wherein the signal generation section generates a display signal for each sub-frame subsequent to a first sub-frame by using an image signal read out from a frame memory in which the incoming image signal is stored, and generates a display signal for the first sub-frame by directly using the incoming image signal without reading any image signal from the frame memory.

29. The display apparatus as set forth in claim 17, wherein a vertical blanking interval of a display signal for each sub-frame in each screen region corresponds to a fraction obtained by dividing a vertical blanking interval of the incoming image signal by the number of sub-frames.

30. The display apparatus as set forth in claim 17, further comprising:

a receiving device configured to receive a television broadcast, which inputs, to the control device of the display apparatus, an image signal indicating an image transmitted by the television broadcast, wherein:

the display module is a liquid crystal display module; and the display apparatus operates as a liquid crystal television receiver.

31. The display apparatus as set forth in claim 17, wherein:

the display module is a liquid crystal display module; and the control device receives an external image signal; and the display apparatus operates as a liquid crystal monitor apparatus that displays an image indicated by the image signal.

32. A display apparatus for, by time-dividing a single frame into a plurality of sub-frames and by displaying, in a single frame period, images respectively corresponding to the plurality of sub-frames, displaying an image corresponding to the single frame, comprising:

a display module having a display screen divided into a plurality of screen regions in each of which an image is able to be independently displayed; and a control device configured to control an image display operation of the display module, wherein the control device including (i) a signal division section for dividing an incoming image signal in accordance with the screen regions of the display module and (ii) a signal generation section for generating a display signal for each of the plurality of sub-frames from the incoming image signal, the number of screen regions into which the display screen has been divided is equal to the number of sub-frames, the control device further includes a timing control section for generating a control signal for controlling an image display operation of each of the sub-frames, the timing control section generating a control signal so that timing of an image display operation of each sub-frame of an identical stage varies between the screen regions in such a manner that an image display operation of each sub-frame of a given stage in an upper one of the screen regions precedes an image display operation of each sub-frame of the same stage in a lower one of the screen regions, and the capacity of address space, contained in a frame memory in which the incoming image signal is stored, which is used in displaying a one-frame still image corresponding to the image signal corresponds to not less than 50% of one screen and less than one screen.

33. The display apparatus as set forth in claim 32, wherein the display screen is equally divided.

34. The display apparatus as set forth in claim 32, wherein the length of a period corresponding to one of the sub-frames is equal to the length of a period corresponding to another one of the sub-frames.

35. The display apparatus as set forth in claim 32, wherein the length of a single horizontal scanning period in the display module is equal to the length of a single horizontal scanning period of the incoming image signal.

36. The display apparatus as set forth in claim 32, wherein each of the number of screen regions into which the display screen has been divided and the number of sub-frames is 2.

37. The display apparatus as set forth in claim 32, wherein the control device further includes a timing control section for generating a control signal for controlling an image display operation of each of the sub-frames, the timing control section generating a control signal so that an operation of causing each pixel of the display screen to display an image in a first sub-frame is carried out before half of a frame period of an image signal has elapsed since the image signal was inputted to the pixel.

38. The display apparatus as set forth in claim 32, wherein the control device further includes a timing control section for generating a control signal for controlling an image display operation of each of the sub-frames, the timing control section generating a control signal so that an operation of causing each pixel of the display screen to display an image in a first sub-frame is carried out before 20% of a frame period of an image signal has elapsed since the image signal was inputted to the pixel.

39. The display apparatus as set forth in claim 32, wherein the timing control section generates a control signal so that an operation of causing each horizontal line of the display screen to display an image is carried out after a certain period of time has elapsed since an image signal was inputted to the horizontal line.

40. The display apparatus as set forth in claim 32, wherein the signal generation section generates a display signal for each sub-frame subsequent to a first sub-frame by using an image signal read out from a frame memory in which the incoming image signal is stored, and generates a display signal for the first sub-frame by directly using the incoming image signal without reading any image signal from the frame memory.

41. The display apparatus as set forth in claim 32, wherein a vertical blanking interval of a display signal for each sub-frame in each screen region corresponds to a fraction obtained by dividing a vertical blanking interval of the incoming image signal by the number of sub-frames.

42. The display apparatus as set forth in claim 32, wherein the timing control section generates a control signal so that, in a given sub-frame, with respect to a delay between (i) a point of time where an image signal is inputted to each horizontal line of a first screen region of the display screen and (ii) a point of time where an operation of causing the horizontal line to display an image is carried out, a delay between (a) a point of time where an image signal is inputted to each horizontal line of a second screen region, situated next to the first screen region, which displays an image after the first screen region has displayed an image and (ii) a point of time where an image display operation is carried out is equal or longer by less than 5% of one frame period.

43. The display apparatus as set forth in claim 32, wherein the signal generation section generates a display signal for each sub-frame subsequent to a first sub-frame by using an image signal read out from a frame memory in which the incoming image signal is stored, and generates a display signal for the first sub-frame by directly using the incoming image signal without reading any image signal from the frame memory.

44. The display apparatus as set forth in claim 32, wherein a vertical blanking interval of a display signal for each sub-frame in each screen region corresponds to a fraction obtained by dividing a vertical blanking interval of the incoming image signal by the number of sub-frames.

45. The display apparatus as set forth in claim 32, further comprising:

a receiving device configured to receive a television broadcast, which inputs, to the control device of the display apparatus, an image signal indicating an image transmitted by the television broadcast, wherein:

the display module is a liquid crystal display module; and the display apparatus operates as a liquid crystal television receiver.

46. The display apparatus as set forth in claim 32, wherein:

the display module is a liquid crystal display module; and the control device receives an external image signal; and the display apparatus operates as a liquid crystal monitor apparatus that displays an image indicated by the image signal.

47. A display apparatus for, by time-dividing a single frame into a plurality of sub-frames and by displaying, in a single frame period, images respectively corresponding to the plurality of sub-frames, displaying an image corresponding to the single frame, comprising:

a display module having a display screen divided into a plurality of screen regions in each of which an image is able to be independently displayed; and a control device configured to control an image display operation of the display module, wherein the control device including (i) a signal division section for dividing an incoming image signal in accordance with the screen regions of the display module and (ii) a signal generation section for generating a display signal for each of the plurality of sub-frames from the incoming image signal, the number of screen regions into which the display screen has been divided is equal to the number of sub-frames, the control device further includes a timing control section for generating a control signal for controlling an image display operation of each of the sub-frames, the timing control section generating a control signal so that timing of an image display operation of each sub-frame of an identical stage varies between the screen regions in such a manner that an image display operation of each sub-frame of a given stage in an upper one of the screen regions precedes an image display operation of each sub-frame of the same stage in a lower one of the screen regions, and the control device further includes a memory control section for controlling writing and reading of a frame memory in which the incoming image signal is stored, when a display signal is generated for a last sub-frame corresponding to a screen region, the memory control section writes, in a region of the frame memory in which region an image signal corresponding to the screen region was stored, an incoming image signal corresponding to another screen region.

48. The display apparatus as set forth in claim 47, wherein the display screen is equally divided.

49. The display apparatus as set forth in claim 47, wherein the length of a period corresponding to one of the sub-frames is equal to the length of a period corresponding to another one of the sub-frames.

50. The display apparatus as set forth in claim 47, wherein the length of a single horizontal scanning period in the display module is equal to the length of a single horizontal scanning period of the incoming image signal.

51. The display apparatus as set forth in claim 47, wherein each of the number of screen regions into which the display screen has been divided and the number of sub-frames is 2.

52. The display apparatus as set forth in claim 47, wherein the control device further includes a timing control section for generating a control signal for controlling an image display operation of each of the sub-frames, the timing control section generating a control signal so that an operation of causing each pixel of the display screen to display an image in a first sub-frame is carried out before half of a frame period of an image signal has elapsed since the image signal was inputted to the pixel.

53. The display apparatus as set forth in claim 47, wherein the control device further includes a timing control section for generating a control signal for controlling an image display operation of each of the sub-frames, the timing control section generating a control signal so that an operation of causing each pixel of the display screen to display an image in a first sub-frame is carried out before 20% of a frame period of an image signal has elapsed since the image signal was inputted to the pixel.

54. The display apparatus as set forth in claim 47, wherein the timing control section generates a control signal so that an operation of causing each horizontal line of the display screen to display an image is carried out after a certain period of time has elapsed since an image signal was inputted to the horizontal line.

55. The display apparatus as set forth in claim 47, wherein the signal generation section generates a display signal for each sub-frame subsequent to a first sub-frame by using an image signal read out from a frame memory in which the incoming image signal is stored, and generates a display signal for the first sub-frame by directly using the incoming image signal without reading any image signal from the frame memory.

56. The display apparatus as set forth in claim 47, wherein a vertical blanking interval of a display signal for each sub-frame in each screen region corresponds to a fraction obtained by dividing a vertical blanking interval of the incoming image signal by the number of sub-frames.

57. The display apparatus as set forth in claim 47, wherein the timing control section generates a control signal so that, in a given sub-frame, with respect to a delay between (i) a point of time where an image signal is inputted to each horizontal line of a first screen region of the display screen and (ii) a point of time where an operation of causing the horizontal line to display an image is carried out, a delay between (a) a point of time where an image signal is inputted to each horizontal line of a second screen region, situated next to the first screen region, which displays an image after the first screen region has displayed an image and (ii) a point of time where an image display operation is carried out is equal or longer by less than 5% of one frame period.

58. The display apparatus as set forth in claim 47, wherein the signal generation section generates a display signal for each sub-frame subsequent to a first sub-frame by using an image signal read out from a frame memory in which the incoming image signal is stored, and generates a display signal for the first sub-frame by directly using the incoming image signal without reading any image signal from the frame memory.

59. The display apparatus as set forth in claim 47, wherein a vertical blanking interval of a display signal for each sub-frame in each screen region corresponds to a fraction obtained by dividing a vertical blanking interval of the incoming image signal by the number of sub-frames.

60. The display apparatus as set forth in claim 47, further comprising:

a receiving device configured to receive a television broadcast, which inputs, to the control device of the display apparatus, an image signal indicating an image transmitted by the television broadcast, wherein:

the display module is a liquid crystal display module; and the display apparatus operates as a liquid crystal television receiver.

61. The display apparatus as set forth in claim 47, wherein:

the display module is a liquid crystal display module; and the control device receives an external image signal; and the display apparatus operates as a liquid crystal monitor apparatus that displays an image indicated by the image signal.

* * * * *

UNITED STATES PATENT AND TRADEMARK OFFICE

CERTIFICATE OF CORRECTION

PATENT NO. : 7,990,358 B2
APPLICATION NO. : 11/884531
DATED : August 2, 2011
INVENTOR(S) : Ishihara It is certified that error appears in the above-identified patent and that said Letters Patent is hereby corrected as shown below:

Title page should read:

Item (86) PCT No.: PCT/JP2006/004383

Signed and Sealed this
Thirty-first Day of January, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,990,358 B2
APPLICATION NO. : 11/884531
DATED : August 2, 2011
INVENTOR(S) : Ishihara It is certified that error appears in the above-identified patent and that said Letters Patent is hereby corrected as shown below:

Title page should read:

Item (86) PCT No.: PCT/JP2006/304383

This certificate supersedes the Certificate of Correction issued January 31, 2012.

Signed and Sealed this
Seventeenth Day of April, 2012

David J. Kappos

David J. Kappos
*Director of the United States Patent and Trademark Office*